US010843485B2

(12) United States Patent
Kimura et al.

(10) Patent No.: US 10,843,485 B2
(45) Date of Patent: Nov. 24, 2020

(54) PRINTING DEVICE

(71) Applicant: SHOWA ALUMINUM CAN CORPORATION, Tokyo (JP)

(72) Inventors: Nobuhiko Kimura, Tokyo (JP); Shinichi Ojima, Tokyo (JP); Kazunori Ikeda, Tokyo (JP); Asumi Suwa, Tokyo (JP); Kenji Fujinuma, Tokyo (JP)

(73) Assignee: SHOWA ALUMINUM CAN CORPORATION, Tokyo (JP)

( * ) Notice: Subject to any disclaimer, the term of this patent is extended or adjusted under 35 U.S.C. 154(b) by 0 days.

(21) Appl. No.: 16/084,421

(22) PCT Filed: Mar. 27, 2017

(86) PCT No.: PCT/JP2017/012346
§ 371 (c)(1),
(2) Date: Sep. 12, 2018

(87) PCT Pub. No.: WO2017/187863
PCT Pub. Date: Nov. 2, 2017

(65) Prior Publication Data

US 2019/0070866 A1 Mar. 7, 2019

(30) Foreign Application Priority Data

Apr. 28, 2016 (JP) ..... 2016-090964
Apr. 28, 2016 (JP) ..... 2016-090965
(Continued)

(51) Int. Cl.
*B41J 3/407* (2006.01)
*B41J 2/015* (2006.01)

(52) U.S. Cl.
CPC ..... *B41J 3/4073* (2013.01); *B41J 2/015* (2013.01)

(58) Field of Classification Search
CPC ..... B41J 3/4073
See application file for complete search history.

(56) References Cited

U.S. PATENT DOCUMENTS 5,835,106 A * 11/1998 No ..... B41F 17/22 347/2
2004/0011227 A1 1/2004 Shadrach, III
(Continued)

FOREIGN PATENT DOCUMENTS

CN 2019-00805 U 7/2011
EP 2 832 548 A1 2/2015
(Continued)

OTHER PUBLICATIONS

International Search Report for PCT/JP2017/012346 dated May 16, 2017 [PCT/ISA/210].
(Continued)

*Primary Examiner* — Jason S Uhlenhake
(74) *Attorney, Agent, or Firm* — Sughrue Mion, PLLC

(57) ABSTRACT

An image is formed on a can body by use of plural image formation units. A printing device (500) is provided with a moving unit (550) that moves while supporting can bodies (10). Additionally, the printing device (500) is provided with a printing unit (520) that includes plural inkjet heads (11W), (11C), (11M), (11Y), (11K) and that performs printing on the can bodies (10) supported by the moving unit (550). Further, the printing device (500) is provided with a moving mechanism (560) that causes the moving unit (550) to move by using a linear mechanism.

14 Claims, 20 Drawing Sheets

(30) Foreign Application Priority Data

Jan. 30, 2017 (JP) ..... 2017-014594
Jan. 30, 2017 (JP) ..... 2017-014600

(56) References Cited

U.S. PATENT DOCUMENTS

| | | | | |
|---|---|---|---|---|
| 2011/0067584 | A1 | 3/2011 | Mueller et al. | |
| 2012/0274695 | A1* | 11/2012 | LaCaze | B41J 2/1752 347/16 |
| 2013/0063505 | A1 | 3/2013 | Buchkremer | |
| 2014/0028771 | A1* | 1/2014 | Yamada | B41J 2/0057 347/104 |
| 2015/0033964 | A1 | 2/2015 | Perego | |
| 2015/0039676 | A1 | 2/2015 | Warren et al. | |
| 2015/0059601 | A1 | 3/2015 | Domeier et al. | |
| 2015/0113918 | A1* | 4/2015 | Ehmer | B41J 3/4073 53/403 |
| 2015/0132490 | A1 | 5/2015 | Perret et al. | |
| 2016/0023471 | A1 | 1/2016 | Jeter | |
| 2016/0355025 | A1 | 12/2016 | Ojima et al. | |

FOREIGN PATENT DOCUMENTS

| | | | | |
|---|---|---|---|---|
| JP | 2012-144264 | A | | 8/2012 |
| JP | 2012-232771 | A | | 11/2012 |
| JP | 2013-51237 | A | | 3/2013 |
| JP | 2013051237 | A | * | 3/2013 |
| JP | 2014-051301 | A | | 3/2014 |
| JP | 2014-512990 | A | | 5/2014 |
| JP | 2015-39676 | A | | 3/2015 |
| JP | 2015-147159 | A | | 8/2015 |
| JP | 2015-196325 | A | | 11/2015 |
| WO | 03/102755 | A1 | | 12/2003 |

OTHER PUBLICATIONS

Communication dated Nov. 7, 2019 from European Patent Office in counterpart EP Application No. 17789152.0.
Communication dated Feb. 28, 2020, From the European Patent Office in application No. 17789152.0.

* cited by examiner

PRINTING DEVICE

CROSS REFERENCE TO RELATED APPLICATIONS

This application is a National Stage of International Application No. PCT/JP2017/012346, filed on Mar. 27, 2017, which claims priority from Japanese Patent Application Nos. 2016-090964, filed on Apr. 28, 2016, 2016-090965, filed on Apr. 28, 2016, 2017-014594, filed on Jan. 30, 2017 and 2017-014600, filed on Jan. 30, 2017.

TECHNICAL FIELD

The present invention relates to a printing device.

BACKGROUND ART

In Patent Document 1, there is disclosed a printing device, in which inkjet printing is performed in at least one inkjet printing station, and plural inkjet heads are arranged in the inkjet printing station.

CITATION LIST

Patent Literature

Patent Document 1: Japanese Patent Application Laid-Open Publication No. 2012-232771

SUMMARY OF INVENTION

Technical Problem

When the can body is moved through each of the plural image formation units to perform printing on the can body, if accuracy in positioning of the can body with respect to each image formation unit is poor, the quality of an image to be formed is deteriorated.

An object of the present invention is to improve the quality of an image formed on a can body by use of plural image formation units.

Moreover, in a printing device, a moving body holding a can body is moved in some cases; however, if the moving body is heavy in weight, a moving speed of the moving body is reduced, and thereby printing efficiency is likely to be deteriorated. Moreover, if the moving body is heavy in weight, an inertia force when the moving body stops is increased, and there is a possibility that the moving body stops at a position different from a position originally planned.

Another object of the present invention is to reduce the weight of the moving body that moves while holding the can body.

Solution to Problem

A printing device to which the present invention is applied includes: a moving body that moves while supporting a can body; a printing unit that includes plural image formation units and performs printing on the can body supported by the moving body; and a mover unit that moves the moving body to pass through each of the plural image formation units and moves the moving body by using a linear mechanism.

Here, in the printing unit, the moving body moves linearly.

Moreover, the can body is supported to cause an axial direction of the can body supported by the moving body to intersect a moving direction of the moving body.

Moreover, the moving body moves along an annular-shaped route, and the can body supported by the moving body is disposed closer to an outer side than an inner side in a radial direction of the annular-shaped route.

Further, the moving body is configured to be capable of supporting plural can bodies.

Moreover, when the moving body is moved by passing through each of the plural image formation units, the mover unit moves the moving body by using the linear mechanism, and at a location other than a location provided with the plural image formation units, the mover unit moves the moving body without using the linear mechanism.

Further, the printing device further includes a driving source that rotates the can body supported by the moving body, and the driving source is placed at a location other than the moving body.

From another standpoint, a printing device to which the present invention is applied includes: a moving body that includes a driving mechanism for rotating a can body and moves while supporting the can body; a printing unit that performs printing on the can body supported by the moving body; and a driving source provided to a location different from the moving body to generate a driving force used by the driving mechanism of the moving body.

Here, the printing device further includes a transmission mechanism that transmits the driving force generated in the driving source to the driving mechanism of the moving body.

Moreover, plural moving bodies are provided, and the transmission mechanism is brought into contact with the driving mechanism provided to each of the plural moving bodies to transmit the driving force to the plural driving mechanisms.

Moreover, the transmission mechanism transmits the driving force to the plural driving mechanisms by using a belt member that circularly moves.

Further, the transmission mechanism is brought into contact with the driving mechanism of the moving body to transmit the driving force to the driving mechanism, and the printing device further includes, across the driving mechanism of the moving body, a support member that supports the driving mechanism from an opposite side of a side where the transmission mechanism is placed.

Moreover, the printing device further includes a reciprocating unit that reciprocates the transmission mechanism with respect to the driving mechanism of the moving body.

Further, the moving body is provided with a permanent magnet, a moving route of the moving body is provided with electromagnets, and the printing device further includes a mover unit that controls energization of the electromagnets to move the moving body.

Advantageous Effects of Invention

According to the present invention, it is possible to improve the quality of an image formed on a can body by use of plural image formation units.

Moreover, according to the present invention, it is possible to reduce the weight of the moving body that moves while holding the can body.

DESCRIPTION OF EMBODIMENTS

Hereinafter, exemplary embodiments according to the present invention will be described with reference to attached drawings.

Figure 1:
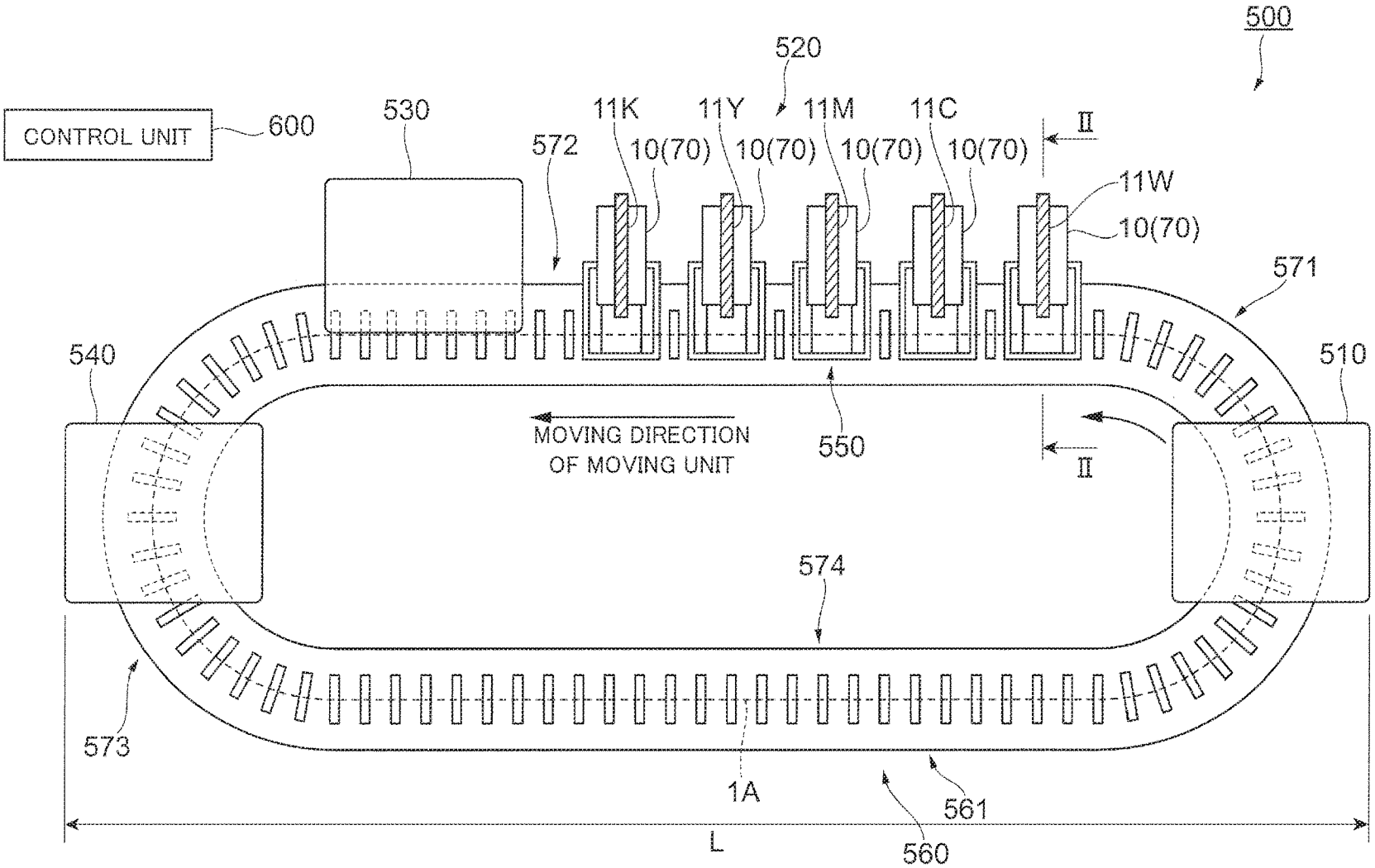
FIG. 1 is a top view of a printing device.

FIG. 1 is a top view of a printing device 500.

The printing device 500 is provided with: a can body loading unit 510 into which can bodies 10 are loaded; a printing unit 520 that performs printing onto the can bodies 10; a drying unit 530 that dries the can bodies 10 on which printing has been finished; and a can body discharge unit 540 that discharges the can bodies 10 that have been dried.

Further, the printing device 500 is provided with: plural moving units 550 that move while supporting the can bodies 10; and a moving mechanism 560 that functions as a part of a mover unit that moves the moving units 550. The moving mechanism 560 is formed into an annular shape.

The printing unit 520 is provided with plural inkjet heads arranged in line in the left and right directions in the figure. Each of the inkjet heads can be recognized as an image formation unit that performs image formation onto the can bodies 10, and the exemplary embodiment includes a configuration in which the printing unit 520 is provided with the plural image formation units.

Specifically, the printing unit 520 is provided with: a first inkjet head 11W that ejects white ink; a second inkjet head 11C that ejects cyan ink; a third inkjet head 11M that ejects magenta ink; a fourth inkjet head 11Y that ejects yellow ink; and a fifth inkjet head 11K that ejects black ink.

In the following description, when there are no particular distinctions among the first inkjet head 11W to the fifth inkjet head 11K, the inkjet heads are simply referred to as "inkjet heads 11".

Here, the five inkjet heads 11, namely, the first inkjet head 11W to the fifth inkjet head 11K perform image formation onto the can bodies 10 by use of ultraviolet cure ink.

Further, in the exemplary embodiment, in a process in which the can bodies 10 pass through below the five inkjet heads 11, ink is ejected to the can bodies 10 from above, and thereby images are formed on the can bodies 10. To put it another way, in the exemplary embodiment, the moving unit 550 moves via each of the plural inkjet heads 11 having been provided. In the process of moving, ejection of ink from each of the inkjet heads 11 to the can bodies 10 is performed, and thereby the images are formed on the can bodies 10.

Note that, in the exemplary embodiment, the case in which the five inkjet heads 11 are provided is shown as an example; however, an inkjet head 11 that ejects ink of a special color, such as a corporate color, may be provided further.

The moving unit 550, as an example of a moving body, moves at a predetermined moving speed, and the can body 10 on the moving unit 550 rotates in the circumferential direction at a predetermined rotation speed.

Note that, in FIG. 1, the five moving units 550 are shown; however, the printing device 500 is provided with more than five moving units 550, and these moving units 550 perform circulating movement by the moving mechanism 560.

In the exemplary embodiment, the timing when the can body 10 reaches each of the inkjet heads 11 is determined in advance, and each of the inkjet heads 11 starts ejection of ink to the timing when the can body 10 reaches the inkjet head 11.

Note that it may be possible to form a positioning mark on a surface of the can body 10 by use of the first inkjet head 11W, and on the second and subsequent inkjet heads 11, the ejection timing of ink may be determined by use of the positioning mark.

Moreover, determination of the ejection timing by use of the positioning mark may be performed by reading bar code or a recycling mark, in addition to reading a dedicated mark.

The drying unit 530 is disposed on a downstream side of the printing unit 520 to irradiate the can body 10 with ultraviolet light. This causes the image formed on an outer circumferential surface of the can body 10 to be cured. In the exemplary embodiment, as described above, image formation onto the can body 10 is performed by use of the ultraviolet cure ink. The drying unit 530 irradiates the can body 10 with ultraviolet light, to thereby cure the image on the can body 10.

Note that, when image formation onto the can body 10 is performed, thermosetting ink may also be used; in this case, heat is applied to the can body 10 to cure the image on the can body 10.

Figure 2:
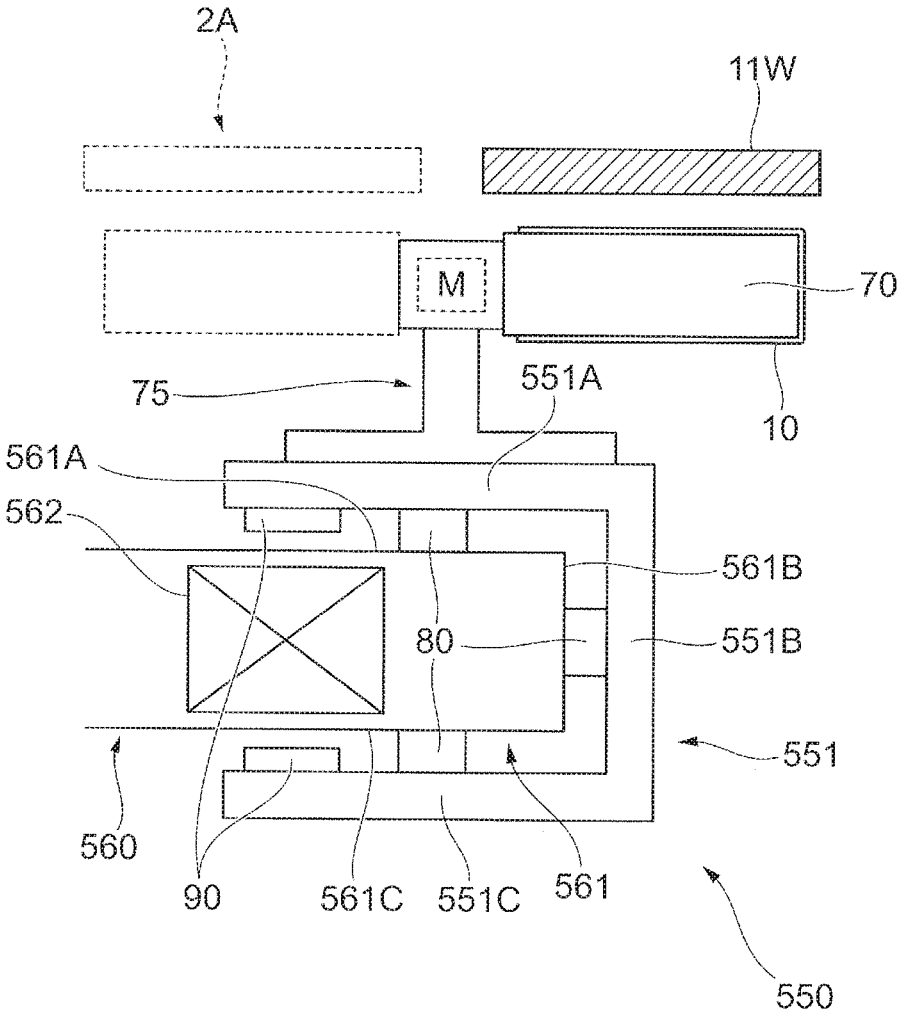
FIG. 2 is a cross-sectional view of a moving unit, a moving mechanism and the like along the II-II line in FIG. 1.

FIG. 2 is a cross-sectional view of the moving unit 550, the moving mechanism 560 and the like along the II-II line in FIG. 1.

The moving mechanism 560 is provided with a guide member 561 that guides the moving unit 550. The guide member 561 includes an upper surface 561A, an outer circumferential surface 561B and a lower surface 561C. Inside the guide member 561, electromagnets 562 are provided.

In the exemplary embodiment, the moving units 550 are moved by use of a linear mechanism.

As shown in FIG. 1, the printing device 500 of the exemplary embodiment is provided with a control unit 600 that functions as a part of the mover unit for controlling energization of the electromagnets 562 to move the moving unit 550. The control unit 600 is composed of a program-controlled CPU (Central Processing Unit).

In conveyance by use of the linear mechanism, the moving speed of the moving unit 550 can be changed with ease. Moreover, in the conveyance by use of the linear mechanism, the moving unit 550 can be moved backward.

In the exemplary embodiment, the moving unit 550 is stopped beneath each of the plural inkjet heads 11 that are provided, to thereby perform image formation onto the can body 10; however, in each of the inkjet heads 11, if positioning accuracy of the moving unit 550 with respect to the inkjet head 11 is poor (if accuracy of the stop position is poor), images of respective colors formed on the can body 10 are deviated from one another, to thereby deteriorate the quality of the image to be formed. When the linear mechanism is used as in the exemplary embodiment, for example, it is possible to set the accuracy of the stop position within 100 μm, and therefore, it is possible to reduce deviation of images of the respective colors. When high-definition printing is required, by devising ideas, such as reducing the moving speed of the moving unit 550, it is possible to obtain positional accuracy of 50 μm to 100 μm, 10 μm to 30 μm, and the like.

As shown in FIG. 2, the moving unit 550 is provided with a guided member 551 that is guided by the guide member 561.

The guided member 551 is provided with: an upper-side facing portion 551A that faces the upper surface 561A of the guide member 561; a side-surface facing portion 551B that faces the outer circumferential surface 561B of the guide member 561; and a lower-side facing portion 551C that faces the lower surface 561C of the guide member 561.

Further, between the guide member 561 and each of the upper-side facing portion 551A, the side-surface facing portion 551B and the lower-side facing portion 551C, there is provided a roll-shaped member 80 that is rotatable. The roll-shaped member 80 is fastened to the guided member 551. The roll-shaped member 80 reduces a slide resistance between the guide member 561 and the guided member 551.

Further, each of the upper-side facing portion 551A and the lower-side facing portion 551C of the guided member 551 is provided with a unit-side magnet 90 configured with a permanent magnet.

In the exemplary embodiment, a propulsive force occurs in the moving unit 550 by magnetic fields generated by electromagnets 562 provided to the guide member 561 and the unit-side magnets 90, and thereby the moving unit 550 moves along the annular-shaped guide member 561.

Further, as shown in FIG. 2, the moving unit 550 includes a mandrel 70 that supports the can body 10 and a support unit 75 that supports the mandrel 70. The support unit 75 is supported by the guided member 551 from below. Inside the support unit 75, there is provided a mandrel motor M that rotates the mandrel 70 in the circumferential direction.

The mandrel 70 is formed into a cylindrical shape. Moreover, the mandrel 70 is disposed in a state of being laid (along the horizontal direction). Consequently, in the exemplary embodiment, the can body 10 is also disposed in the state of being laid.

Further, in the exemplary embodiment, as shown in FIG. 1, there are provided plural moving units 550. Moreover, the moving unit 550 passes through a region positioned below the plurally provided inkjet heads 11.

Further, the moving unit 550 stops every time the moving unit 550 reaches below each inkjet head 11. Further, in the exemplary embodiment, the mandrel motor M (refer to FIG. 2) is driven to rotate the mandrel 70 (refer to FIG. 2) in the circumferential direction. Further, ejection of ink from the inkjet head 11 is performed.

Then, when the mandrel 70 rotates 360° after ejection of ink is started, ejection of ink is stopped. Consequently, an image is formed on the outer circumferential surface of the can body 10.

Note that the mandrel 70 may be rotated every time the mandrel 70 reaches below each inkjet head 11, or the mandrel 70 may be continuously rotated during a period from the start of the moving unit 550 from the can body loading unit 510 to reaching the can body discharge unit 540.

Here, in the exemplary embodiment, as shown in FIG. 1, the mandrel 70 is disposed sideways. Specifically, the mandrel 70 is disposed along the direction perpendicular to (crossing) the moving direction of the moving unit 550. In other words, in the exemplary embodiment, the can body 10 is conveyed in the state in which the axial direction of the can body 10 is perpendicular to (crossing) the moving direction of the moving unit 550.

In such a case, as compared to a case in which the mandrel 70 is disposed along the moving direction of the moving unit 550, it is possible to reduce the length L of the printing device 500. In other words, it is possible to reduce the full length of the moving route on which the moving unit 550 moves.

Then, in this case, it is possible to reduce the production costs of the printing device 500. In the case of the printing device 500 that performs printing in the course of moving the can body 10, the production costs are likely to be increased corresponding to the length of the moving route of the can body 10. In particular, in the case of linear conveyance, the production costs are increased.

As in the exemplary embodiment, in the case in which the mandrel 70 is disposed sideways, it is possible to reduce the moving route of the moving unit 550, to thereby reduce the production costs of the printing device 500.

Moreover, by disposing the mandrel 70 sideways, it is possible to increase disposition density of the moving units 550 in the moving direction of the moving units 550, to thereby increase the number of the moving units 550 that can be installed.

Further, in the exemplary embodiment, as shown in FIG. 1, the mandrel 70 and the inkjet head 11 are disposed sideways, and are also provided to project outward in the radial direction of the guide member 561. To additionally describe, the mandrel 70 and the inkjet head 11 are disposed to be closer to the outer side, rather than the inner side, in the radial direction of the guide member 561.

To describe further, in the exemplary embodiment, the moving units 550 move along the annular-shaped moving route shown by the reference sign 1A in the figure, and the can bodies 10 are disposed to be closer to the outer side, rather than the inner side, in the radial direction of the annular-shaped moving route.

There are some cases of performing maintenance of the mandrels 70 and the inkjet heads 11; in such cases, when the mandrels 70 and the inkjet heads 11 are made to be closer to the outer side as in the exemplary embodiment, maintenance is performed with ease as compared to a case in which the mandrels 70 and the inkjet heads 11 are made to be closer to the inner side.

Moreover, in the exemplary embodiment, as described above, the inkjet heads 11 are disposed above the can bodies 10, and the ink is ejected to the can bodies 10 from above.

In this case, as compared to a case in which the inkjet heads 11 are disposed at the lateral side of the can bodies 10 or below the can bodies 10, it is possible to reduce the effect of gravity acting on ink droplets ejected from the inkjet heads 11, to thereby increase accuracy of ink adhesive positions in the can body 10.

Note that, in FIG. 2, there is shown the case in which the mandrel 70 and the inkjet head 11 are provided on the right side of the support unit 75 in the figure; however, as indicated by the reference sign 2A in FIG. 2, the mandrel 70 and the inkjet head 11 may be provided on the left side of the support unit 75 in the figure.

Moreover, the mandrels 70 and the inkjet heads 11 may be provided on both sides, namely, the right side and the left side, of the support unit 75 in the figure.

When the mandrels 70 and the inkjet heads 11 are provided on the right and left sides of the support unit 75 (on both sides of the support unit 75), as compared to the case in which the mandrel 70 and the inkjet head 11 are provided on only one side of the support unit 75, it is possible to increase the number of can bodies 10 on which printing can be performed per unit time.

Moreover, when the mandrels 70 are provided on both sides of the support unit 75, a balance between the right and the left of the moving unit 550 (the right and the left in FIG. 2) is improved, and therefore, it is possible to suppress inclination of the moving unit 550 caused by the weight of the mandrel 70.

Note that, when the mandrels 70 are provided on both sides of the support unit 75, the mandrel motor M may be provided in correspondence with each mandrel 70 (the mandrel motor M may be provided to each and every one of the mandrels 70), or, two mandrels 70 positioned on both sides may be rotated by a single mandrel motor M (plural mandrels 70 may be rotated).

Here, when two mandrels 70 are rotated by a single mandrel motor M, for example, a transmission gear is placed between the mandrel motor M and the two mandrels 70, to thereby transmit the rotational driving force from the mandrel motor M to each of the mandrels 70.

When the mandrels 70 are provided on the both sides of the support unit 75, directions of the can bodies 10 mounted on the mandrels 70 differ from each other. In the two mandrels 70 positioned on the both sides of the support unit 75, heading directions of leading end portions of the mandrels 70 differ from each other; in such a case, directions of the can bodies 10 to be mounted also differ.

Moreover, depending on the configuration of the above-described transmission gear, the two can bodies 10 rotates in the same direction or in the opposite directions.

In such a case, if ejection control in two inkjet heads 11 provided in correspondence to two can bodies 10 is performed in the same manner, there is a possibility that an image formed on one of the can bodies 10 differs from the image originally planned.

Therefore, when the mandrels 70 are provided on both sides of the support unit 75, by conducting image processing, such as rotational processing or reversal processing of image data used for printing, image data tailored to orientations or rotation directions of the mandrels 70 to perform image formation onto the can bodies 10 by use of the image data.

Next, the moving mechanism 560 will be described.

As shown in FIG. 1, the guide member 561 provided to the moving mechanism 560 is formed into an annular shape. Further, the guide member 561 includes: a first curve portion 571 having a curvature; a first linear portion 572 formed into a linear shape; a second curve portion 573 having a curvature; and a second linear portion 574 formed into a linear shape.

The first linear portion 572 and the second linear portion 574 are disposed to be in parallel with each other. The first linear portion 572 and the second linear portion 574 are disposed to face each other.

Moreover, the first curve portion 571 connects one end portion of the first linear portion 572 and one end portion of the second linear portion 574. Moreover, the second curve portion 573 connects the other end portion of the first linear portion 572 and the other end portion of the second linear portion 574.

In the exemplary embodiment, the first curve portion 571 is provided with the can body loading unit 510. Moreover, the first linear portion 572 is provided with the printing unit 520 and the drying unit 530. Further, the second curve portion 573 is provided with the can body discharge unit 540.

Figure 3:
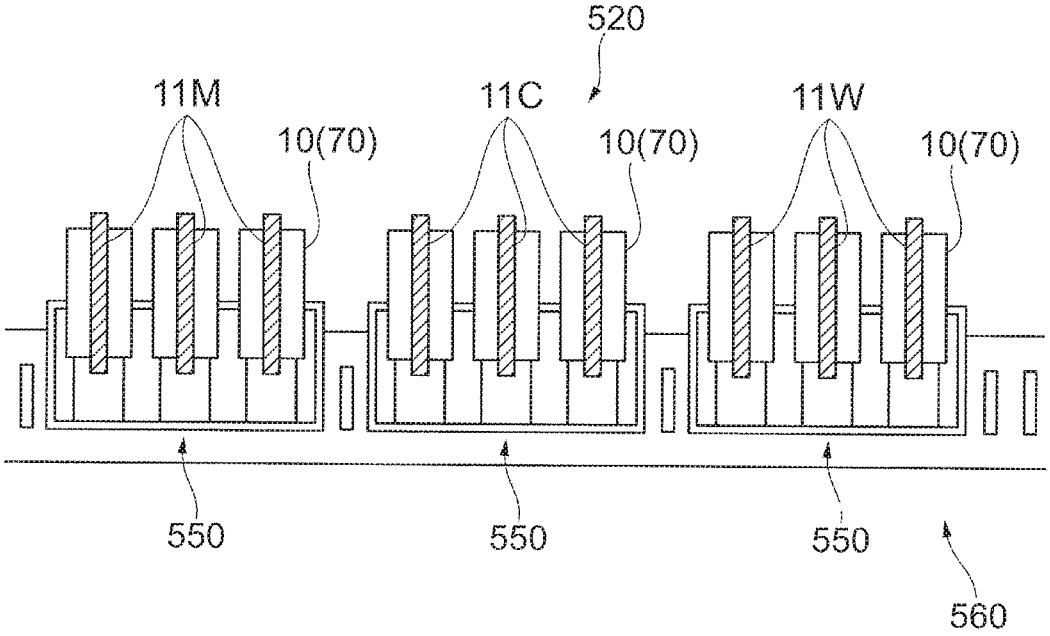
FIG. 3 is a diagram showing another configuration example of a printing unit and the moving unit.

FIG. 3 is a diagram showing another configuration example of the printing unit 520 and the moving unit 550.

In this configuration example, a single moving unit 550 is provided with three (plural) mandrels 70, and therefore, each moving unit 550 moves while holding three can bodies 10.

Further, the printing unit 520 is provided with three inkjet heads 11 of the same color corresponding to the three mandrels 70. Specifically, three inkjet heads 11 are provided for each color.

Note that, in FIG. 3, illustration of the fourth inkjet head 11Y for yellow and the fifth inkjet head 11K for black is omitted; however, three inkjet heads 11 are also provided to each of the fourth inkjet head 11Y for yellow and the fifth inkjet head 11K for black.

In this configuration example shown in FIG. 3, each moving unit 550 stops below the three inkjet heads 11 provided for each color.

Then, in each moving unit 550, the three mandrels 70 (can bodies 10) are rotated, and further, ink ejection from the three inkjet heads 11 ejecting ink of the same color is performed onto each can body 10. Consequently, similar to the above, an image is formed on the outer circumferential surface of the can body 10.

In the configuration example shown in FIG. 3, printing efficiency can be increased as compared to the configuration in FIG. 1 in which printing is performed each time the moving unit 550 arrives at an adjacent inkjet head 11.

Further, in the configuration example, in each of the three inkjet heads 11 ejecting ink of the same color, ink ejection is performed at the same timing. Consequently, it is possible to simplify the processing as compared to the configuration in which the timing of ink ejection differs in each of the inkjet heads 11.

Note that, when the plural mandrels 70 are provided to the moving unit 550, it is preferable to set the number of mandrels 70 to be installed in the range of two to eight. If there are nine or more mandrels 70, the moving unit 550 becomes heavy; accordingly, there is a possibility that it becomes difficult to control the position of the moving unit 550.

Specifically, if the moving unit 550 becomes heavy, the inertia force of the moving unit 550 when the moving unit 550 stops is increased, and therefore, the stop position of the moving unit 550 is likely to be deviated from the intended position.

Note that, when the plural mandrels 70 are provided to the moving unit 550, the preferable number of mandrels 70 to be installed is in the range of two to four.

Figure 4A:
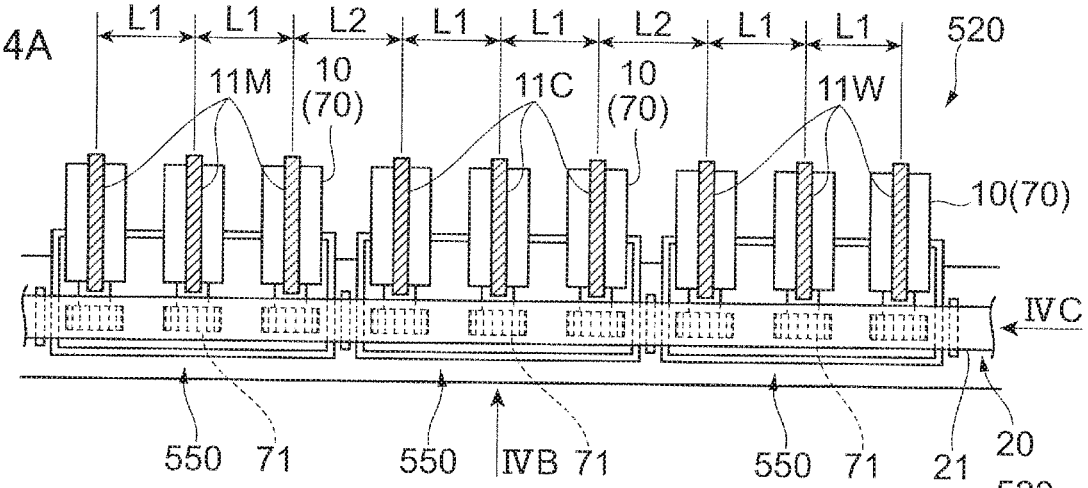
FIGS. 4A, 4B and 4C are diagrams showing another configuration example of the printing unit.
Figure 4B:
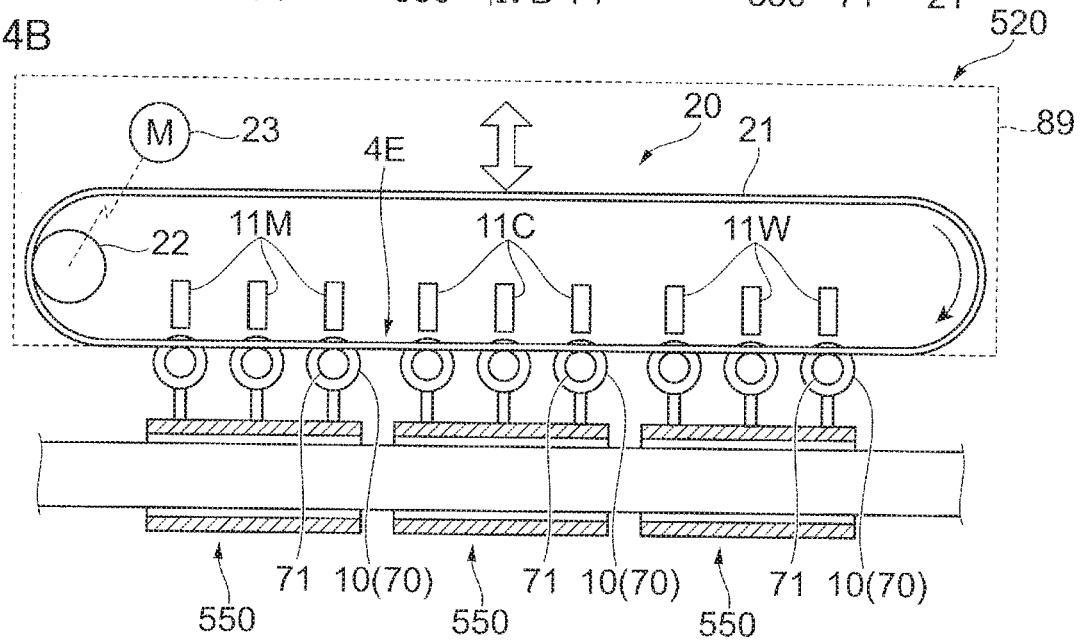
Figure 4C:
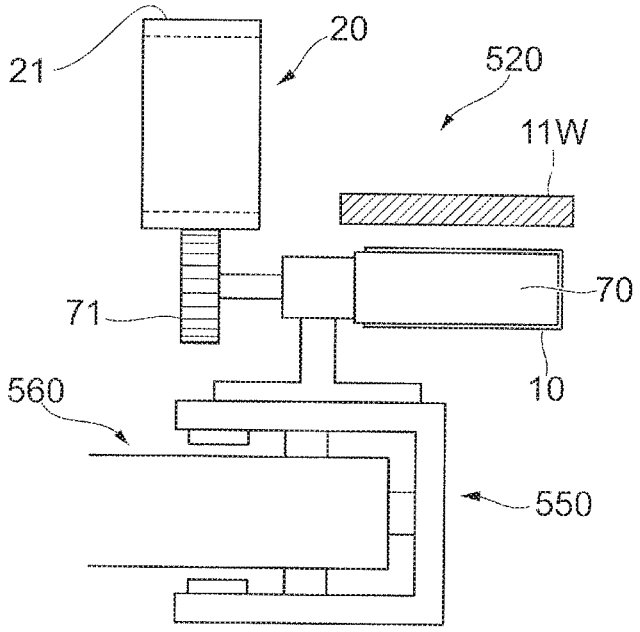

FIGS. 4A, 4B and 4C are diagrams showing another configuration example of the printing unit 520.

Note that FIG. 4A is a top view, FIG. 4B is a diagram in which the printing unit 520 is viewed from the direction of the arrow IVB in FIG. 4A, and FIG. 4C is a diagram in which the printing unit 520 is viewed from the direction of the arrow IVC in FIG. 4A.

In the configuration example shown in FIG. 4, the moving unit 550 is not provided with the mandrel motor M.

In the configuration example, as shown in FIG. 4B, the mandrels 70 provided to each moving unit 550 are driven by a mandrel driving mechanism 20 provided to a portion different from the moving unit 550.

The mandrel driving mechanism 20 includes: a belt member 21 formed into an endless shape to perform circulating movement; a drive roll 22 disposed in contact with the belt member 21 to rotate the belt member 21; and a belt motor 23 that rotates the drive roll 22. Further, though illustration is omitted, the mandrel driving mechanism 20 includes tension rolls that extend the belt member 21 from inside.

Here, the belt motor 23 as an example of a driving source generates a driving force for rotating the can bodies 10 supported by the moving unit 550. The driving force is transmitted to the can bodies 10 via the belt member 21 and the like.

The belt member 21 is, as shown in FIG. 4C, disposed in contact with the mandrels 70. More specifically, each moving unit 550 is provided with a gear disposed coaxially with the mandrel 70 (hereinafter, referred to as "mandrel-side gear 71"), and the belt member 21 is engaged with the mandrel-side gear 71.

On the outer circumferential surface of the belt member 21, a gear (concavo-convex portion) is formed; in the exemplary embodiment, the gear of the belt member 21 is engaged with the mandrel-side gear 71, and thereby the rotational driving force is transmitted from the belt member 21 performing circulating movement to the mandrel 70.

In the exemplary embodiment, when the moving unit 550 reaches the printing unit 520 (refer to FIG. 4B), the mandrel-side gear 71 provided to the moving unit 550 is brought into contact with the belt member 21, and thereby engagement of the mandrel-side gear 71 and the belt member 21 is caused. Consequently, it becomes possible to rotate the mandrel 70 in the circumferential direction.

In other words, in the exemplary embodiment, the mandrel-side gear 71 and the mandrel 70 function as a driving mechanism that rotates the can body 10, and the drive roll 22 and the belt member 21 function as a transmission mechanism that transmits the driving force generated by the belt motor 23 to the driving mechanism. In the exemplary embodiment, the mandrel-side gear 71 that functions as a part of the driving mechanism is brought into contact with the belt member 21 that functions as a part of the transmission mechanism, and accordingly, the mandrel 70 is rotated in the circumferential direction.

Note that, in the exemplary embodiment, as shown in FIG. 4C, the belt member 21 is brought into contact with an upper-side portion of the mandrel-side gear 71; however, there may be a configuration in which the belt member 21 is brought into contact with a lower-side portion of the mandrel-side gear 71.

Moreover, in the exemplary embodiment, as shown in FIG. 4B, the mandrel-side gear 71 is brought into contact with the outer circumferential surface of the belt member 21; however, there may be a configuration in which the mandrel-side gear 71 is brought into contact with an inner circumferential surface of the belt member 21. In this case, as compared to the case in which the mandrel-side gear 71 is brought into contact with the outer circumferential surface of the belt member 21, it is possible to downsize the printing device 500.

Moreover, in the exemplary embodiment, the configuration of the printing unit 520 was described; however, the mandrel driving mechanisms 20 are provided to the drying unit 530 (refer to FIG. 1) and the like, and therefore, the can bodies 10 are also rotated in the circumferential direction in the drying unit 530 and the like.

In the configuration example shown in FIG. 4, it is possible to increase the accuracy of stop position of the moving unit 550, and further, it is possible to reduce the driving sources.

If the mandrel motor M is placed to each of the moving units 550, the gravity of the moving unit 550 is increased, and thereby the inertia force when the moving unit 550 stops is increased. In such a case, there is a possibility that the accuracy of the stop position of the moving unit 550 is decreased.

In contrast thereto, in the exemplary embodiment, the driving source is provided separately from the moving unit 550, and therefore the driving force is supplied to the moving unit 550 from the outside of the moving unit 550.

In the case of such a configuration, it is possible to make the moving unit 550 lighter, and thereby the inertia force when the moving unit 550 stops is reduced. Then, in this case, it is possible to increase the accuracy of the stop position of the moving unit 550.

Further, in the configuration in which the mandrel motor M is provided to each of the moving units 550, the mandrel motors M are provided in correspondence to the number of the moving units 550, which leads to increase of the driving sources, and thereby the production costs of the printing device 500 are increased.

In contrast thereto, in the configuration example shown in FIG. 4, the driving source is shared, to thereby make it possible to reduce the driving sources. Then, in this case, it is possible to reduce the production costs of the printing device 500.

Note that, in the exemplary embodiment, the case in which the belt member 21 extending along the moving direction of the moving unit 550 is placed to rotate each of the mandrels 70 was described; however, rotation of each of the mandrels 70 may be performed by use of other than the belt member 21.

For example, it may be possible that a gear (not shown) (hereinafter, referred to as "rotation gear") that rotates corresponding to each of the inkjet heads 11 is installed, and the mandrel-side gear 71 is caused to engage with the rotation gear, to thereby rotate each of the mandrels 70.

Note that, in this case, each rotation gear may be rotated by the common driving source, or may be rotated by the driving source prepared for each of the rotation gears.

The belt member 21 or each rotation gear may be rotated during the period in which the moving unit 550 moves, or may be stopped, and after the moving unit 550 stops below the inkjet head 11, start to be rotated. Note that, when the belt member 21 is rotated all the time, the driving force is supplied from the belt member 21 to the mandrels 70 even when the moving unit 550 moves between the inkjet heads 11. In this case, the moving unit 550 moves while the mandrels 70 on the moving unit 550 are rotated.

Note that, the quality of the image formed on the can body 10 is likely to be improved by causing the belt member 21 to rotate the plural mandrels 70 rather than by rotating the mandrels 70 by the rotation gears individually provided to the respective mandrels 70.

In the case of rotating the plural mandrels 70 by the belt member 21, misregistration in positions of images of respective colors can be reduced, and therefore, it is possible to improve quality of the image to be formed.

In the case where the rotation gear is provided in correspondence with each of the mandrels 70, there is a possibility that mutual positions of the respective rotation gears are misaligned due to dimensional tolerances of components or the like. In such a case, the position of the mandrel 70 when the mandrel-side gear 71 is engaged with the rotation gear (the position of the mandrel 70 with respect to the inkjet head 11) is likely to differ in each of the rotation gears with which the mandrel-side gear is engaged. In such a case, misregistration is likely to occur among images of the respective colors formed on the can body 10.

In contrast thereto, when the continuous belt member 21 is used, positions of the mandrels 70 are less likely to be changed since the mandrels 70 are synchronized, and therefore, misregistration is less likely to occur among the images of the respective colors to be formed on the can body 10.

Another configuration example will be further described.

Figure 5:
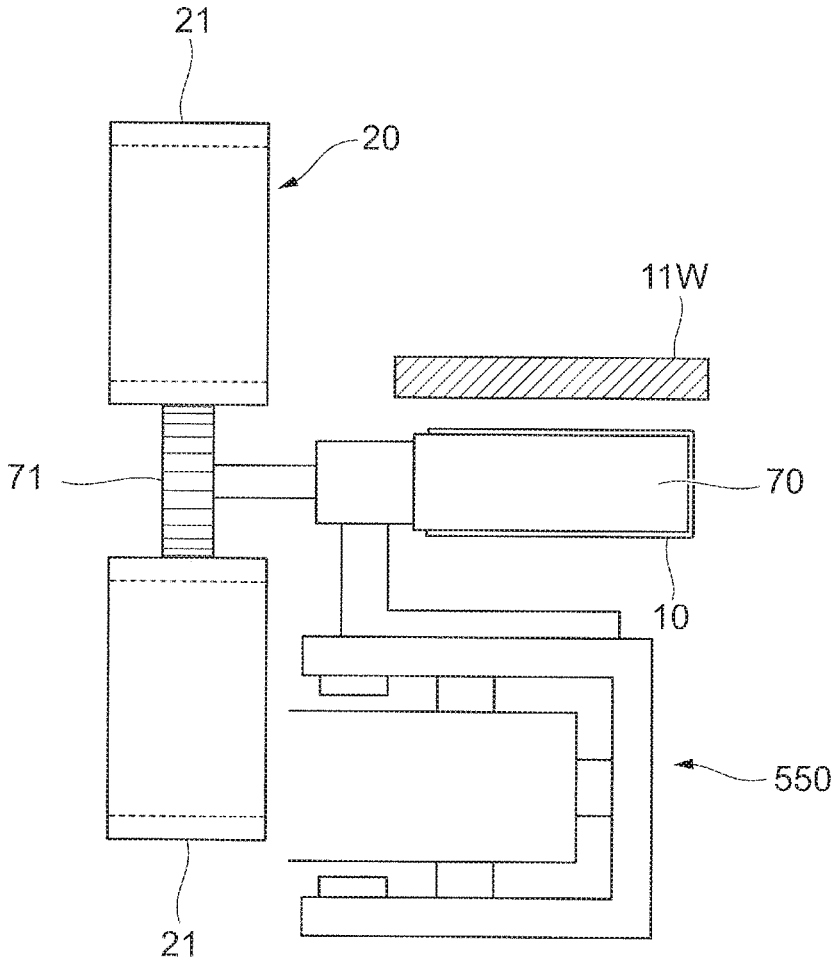
FIG. 5 is a diagram showing another configuration example of a mandrel driving mechanism.

In the configuration example shown in FIG. 5 (the diagram showing another configuration example of the mandrel driving mechanism 20), on both sides of the mandrel-side gear 71, namely, on the upper side and the lower side in the figure, the belt members 21 applying the rotational driving force to the mandrel-side gear 71 are placed.

In the case of the configuration example shown in FIG. 4C, the mandrel-side gear 71 pressed by the belt member 21 from above, and the load that causes the mandrel 70 to be inclined acts on the mandrel-side gear 71.

In contrast thereto, in the configuration example shown in FIG. 5, the mandrel-side gear 71 is supported by the belt member 21 as an example of the support member (the lower-side belt member 21 in the figure) from below, and therefore, inclination of the mandrel 70 is less likely to occur as compared to the configuration example shown in FIG. 4C.

In other words, in the configuration example shown in FIG. 5, the belt member 21 on the upper side in the figure can be recognized as a transmission mechanism that transmits the rotational driving force to the mandrel-side gear 71. Then, in the configuration example, from an opposite side of the installation side of the transmission mechanism across the mandrel-side gear 71, the mandrel-side gear 71 is supported by the belt member 21 (the lower-side belt member 21 in the figure).

Note that, in FIG. 5, description was given of the case in which the belt members 21 were placed on both sides, namely, the upper side and the lower side of the mandrel-side gear 71 in the figure; however, it may be possible that the above-described rotation gears are placed instead of the belt members 21 (the rotation gears are placed on the upper side and the lower side of the mandrel-side gear 71) and rotation of the mandrel-side gear 71 and support of the mandrel-side gear 71 are performed by the rotation gears.

Moreover, the belt member 21 may be placed on one of the upper side and the lower side of the mandrel-side gear 71 in the figure, and the rotation gear may be placed on the other side.

Moreover, there may be a configuration in which one of the two members (the belt member 21 or the rotation gear) disposed on the upper side and the lower side of the mandrel-side gear 71 in the figure does not supply the rotational driving force to the mandrel-side gear 71.

In this case, the one of the members mainly supports the mandrel-side gear 71. Moreover, in this case, the one of the members rotates to follow the mandrel-side gear 71.

Moreover, as shown in FIG. 4B, there may be provided a reciprocating mechanism 89 as an example of a reciprocating unit that reciprocates the mandrel driving mechanism 20 with respect to (the mandrel-side gear 71 of) the moving unit 550, and the mandrel driving mechanism 20 may be vertically moved by the reciprocating mechanism 89, to thereby reciprocate the mandrel driving mechanism 20 with respect to the moving unit 550.

Specifically, for example, in the course of movement of the moving unit 550 (in the course of movement of the moving unit 550 between the inkjet heads 11), the mandrel driving mechanism 20 is retracted upwardly. Then, when the moving unit 550 stops below the inkjet head 11, the mandrel driving mechanism 20 is lowered, and the belt member 21 of the mandrel driving mechanism 20 is brought into contact with the mandrel-side gear 71.

Note that, in this case, the belt member 21 may be rotated after the belt member 21 is brought into contact with the mandrel-side gear 71, or the belt member 21 is rotated all the time and the rotating belt member 21 may be brought into contact with the mandrel-side gear 71.

Moreover, in the configuration example shown in FIG. 4B, the configuration that vertically moves the entirety of the mandrel driving mechanism 20 was described; however, there may be a configuration in which only the portion indicated by the reference sign 4E in FIG. 4B (of the belt members 21, the portion positioned on the lower side) is vertically moved.

Moreover, the same is true in the above-described rotation gear; it may be possible that the rotation gear is allowed to move vertically, and therefore, the rotation gear is brought into contact with the mandrel-side gear 71 and is retracted from the mandrel-side gear 71.

If the mandrel-side gear 71 of the moving unit 550 that has been moved from the upstream side is brought into contact with the belt member 21 in circulating movement or the rotating rotation gear, an impact on the moving unit 550 is increased, or, wearing of the mandrel-side gear 71 or the like is apt to be accelerated.

As in the exemplary embodiment, when the belt member 21 or the rotation gear is brought into contact with the moving unit 550 that is stopped, it is possible to reduce the impact on the moving unit 550, and further, it is possible to suppress wearing of the mandrel-side gear 71 or the like.

Note that, in the configuration example shown in FIG. 4A, a single inkjet head group is configured with three inkjet heads 11 provided for each color; further, every interval between the inkjet heads 11 is a head interval L1, every separation distance between the inkjet head groups adjacent to each other is a separation distance L2, and all the intervals L1 between the inkjet heads 11 are the same and the separation distances L2 of the adjacent inkjet head groups are the same.

In this case, inkjet heads 11 are positioned at regular intervals, and further, a moving distance when each moving unit 550 is moved to the inkjet head group positioned adjacently is the same in every moving unit 550, and thereby it becomes possible to simplify the control to move the moving unit 550.

Here, it is preferable to set the head interval L1 and the separation distance L2 at shortest distances within a range in which interference does not occur among the can bodies 10 and among the inkjet heads 11 because the above-described moving distance becomes the shortest.

Further, at this time, it is preferable that the rotation speed of the can body 10 is set so that, for example, when the can body 10 moves from the position of the inkjet head 11W to the position of the inkjet head 11C, in other words, the can body 10 moves the distance (2×L1+L2), the print start point of the can body 10 at the inkjet head 11W is at the position facing the inkjet head 11C. By doing this, at the position of the inkjet head 11C, there is no waiting time for the above-described print start point on the can body 10 to come to the position facing the inkjet head 11C by rotation.

Figure 6A:
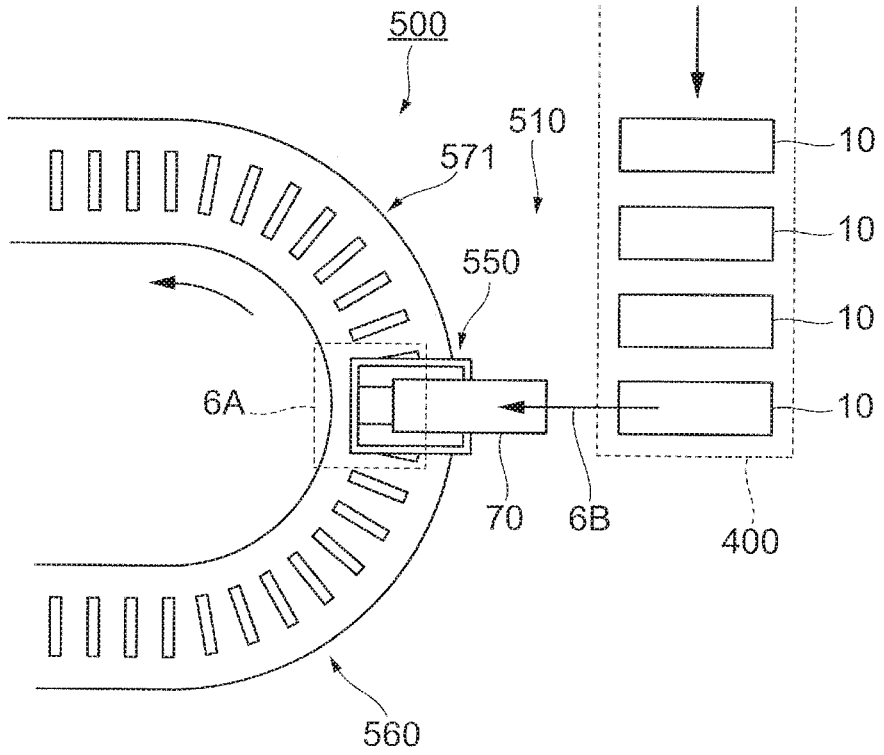
FIGS. 6A and 6B are diagrams each illustrating a can body loading unit.
Figure 6B:
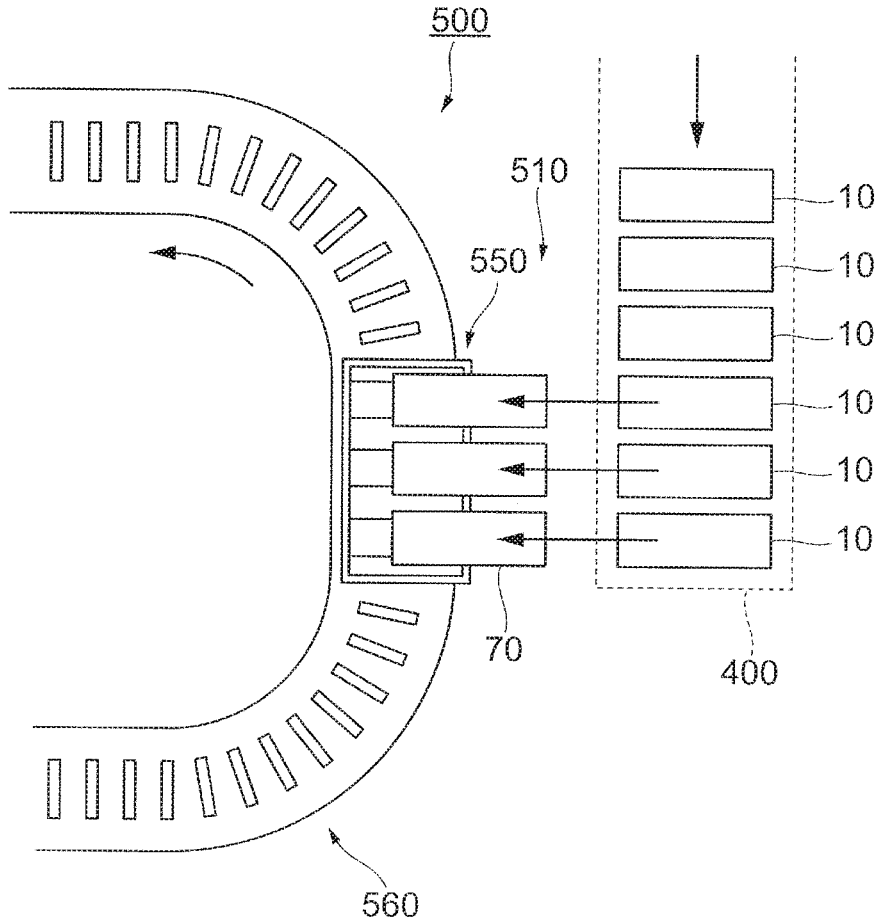
Figure 7:
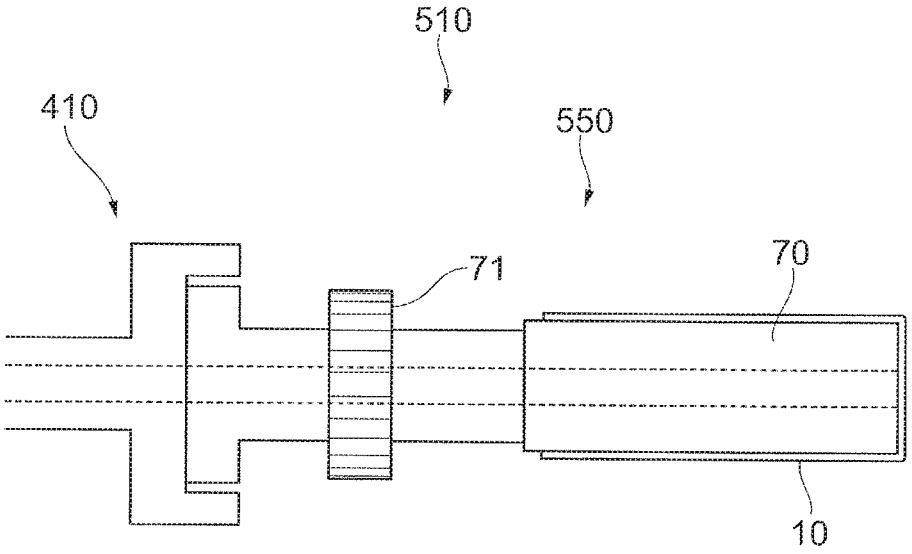
FIG. 7 is an enlarged view of a portion indicated by the reference sign 6A in FIG. 6A.

FIGS. 6A and 6B are diagrams each illustrating the can body loading unit 510. FIG. 7 is an enlarged view of a portion indicated by the reference sign 6A in FIG. 6A.

As shown in FIG. 6A, the can body loading unit 510 in the exemplary embodiment is provided to the first curve portion 571 of the moving mechanism 560.

To the can body loading unit 510, the can bodies 10, on which printing has not yet been performed, are sequentially conveyed by the conveyance mechanism 400. Then, as indicated by the arrow 6B in FIG. 6A, the can body 10 is pushed toward the mandrel 70 provided to the moving unit 550 (pushed by a not-shown pushing mechanism), and thereby the mandrel 70 is inserted into the can body 10. Consequently, support of the can body 10 by the mandrel 70 is started.

Note that, in the can body loading unit 510, suction of air inside the mandrel 70 is performed on a rear end portion side of the mandrel 70 (on an end portion side opposite to the leading end portion on which insertion into the can body 10 is started), and when the can body 10 is mounted onto the mandrel 70, the can body 10 is sucked by the mandrel 70.

Specifically, as shown in FIG. 7, the can body loading unit 510 is provided with a suction device 410; in the can body loading unit 510, the suction device 410 is connected to the moving unit 550, and thereby air inside the mandrel 70 is sucked by the suction device 410. Consequently, suction of the can body 10 by the mandrel 70 is carried out and the mandrel 70 is inserted into the can body 10.

Note that, as shown in FIG. 6B, when the plural mandrels 70 are provided to the moving unit 550, the can bodies 10 of the number corresponding to the number of set mandrels 70 are moved toward the mandrels 70.

Figure 8A:
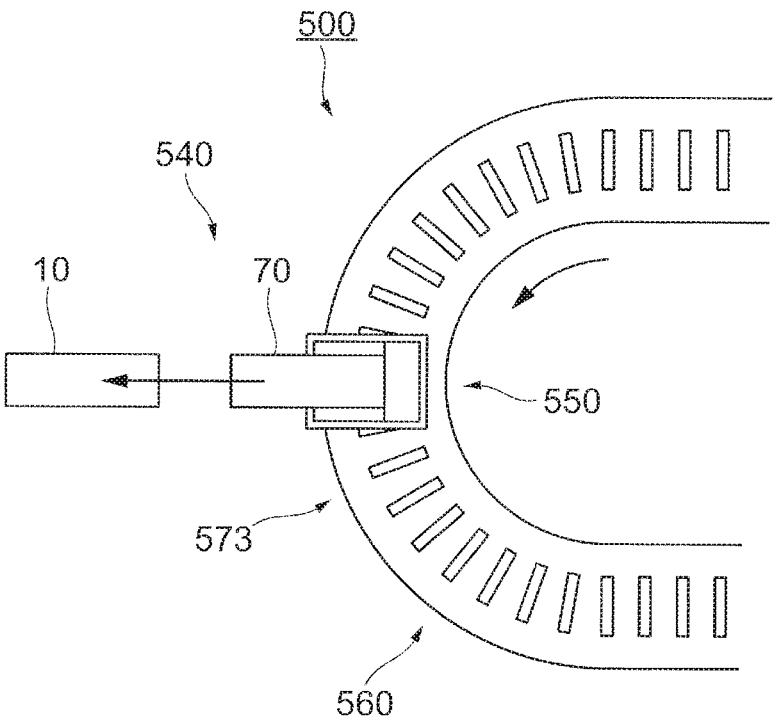
FIGS. 8A and 8B are diagrams each illustrating a can body discharge unit.
Figure 8B:
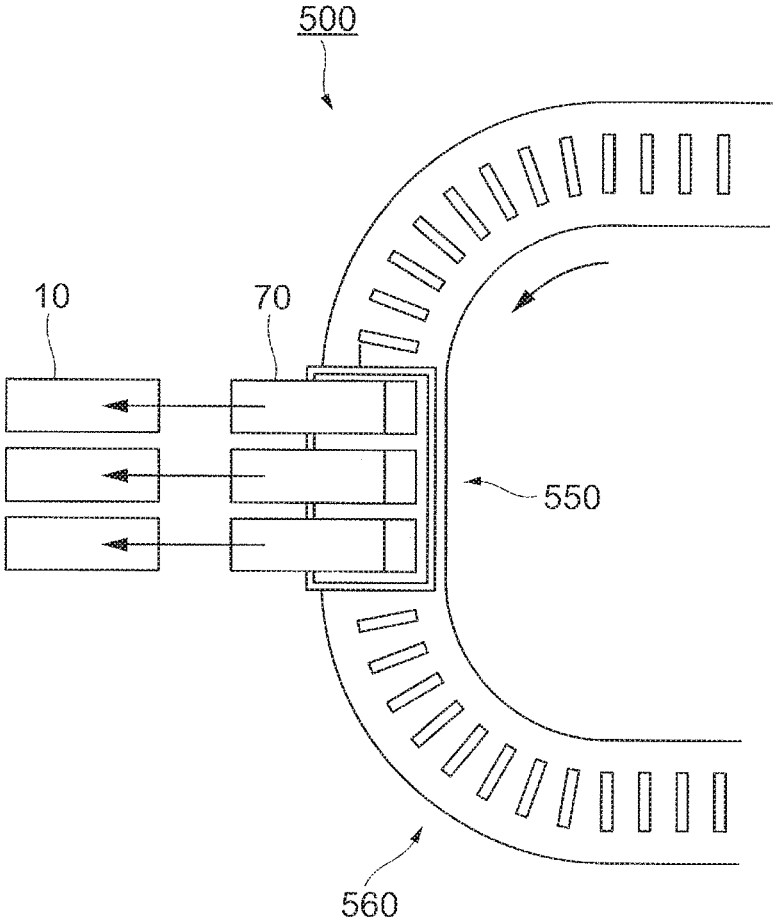

FIGS. 8A and 8B are diagrams each illustrating the can body discharge unit 540.

As shown in FIG. 8A, the can body discharge unit 540 is provided to the second curve portion 573 of the moving mechanism 560.

In the can body discharge unit 540, by use of a not-shown air supply device, compressed air is supplied to the inside of the mandrel 70 from the rear end portion side of the mandrel 70. Consequently, the can body 10 is pushed by the compressed air and the can body 10 is detached from the mandrel 70. Note that the can body 10 detached from the mandrel 70 is conveyed to the next process by a not-shown conveyance mechanism.

Note that, as shown in FIG. 8B, when the plural mandrels 70 are provided to the moving unit 550, the compressed air is supplied to the inside of each of the mandrels 70, to thereby detach the can bodies 10 from all the mandrels 70.

Here, in the exemplary embodiment, as shown in FIG. 1, the printing unit 520 is provided to the first linear portion 572 of the moving mechanism 560. If the printing unit 520 is provided to the first curve portion 571 or the second curve portion 573, positions of the can bodies 10 with respect to the inkjet heads 11 are likely to be changed, and accordingly, there is a possibility that the quality of image to be formed is deteriorated.

On the other hand, by providing the printing unit 520 to the first linear portion 572, image formation onto the can body 10 is performed in the course of linear movement of the moving unit 550. In this case, positions of the can bodies 10 with respect to the inkjet heads 11 are less likely to be changed, and therefore, it is possible to suppress deterioration of quality of images to be formed on the can bodies 10.

Figure 9:
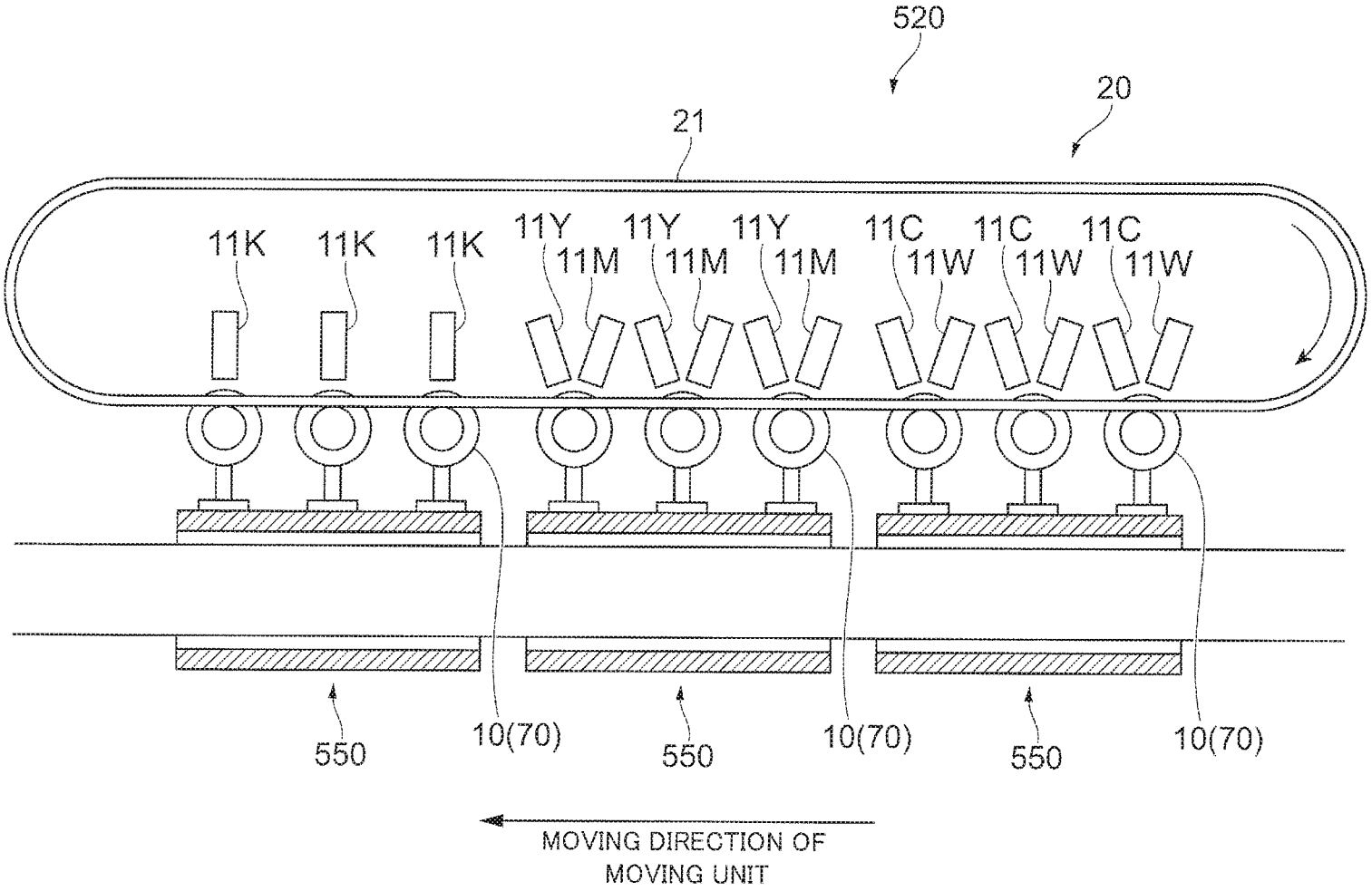
FIG. 9 is a diagram showing another configuration example of the printing unit.

FIG. 9 is a diagram showing another configuration example of the printing unit 520.

In this configuration example, above a single mandrel 70 (can body 10), plural inkjet heads 11 are disposed. Specifically, in the moving unit 550 positioned on the most upstream side in the figure, three mandrels 70 are disposed.

Above each of the three mandrels 70, two inkjet heads 11, namely, the first inkjet head 11W for white and the second inkjet head 11C for cyan are installed.

Moreover, in the moving unit 550 positioned on the second from the upstream side in the figure, above each of the three mandrels 70, two inkjet heads 11, namely, the third inkjet head 11M for magenta and the fourth inkjet head 11Y for yellow are installed.

Note that, in the moving unit 550 positioned on the most downstream side, above each of three mandrels 70, the fifth inkjet head 11K for black is installed. At this time, when an inkjet head 11 that ejects ink of a special color, such as a corporate color, the inkjet head 11 may be installed at the position of the moving unit 550 positioned on the most downstream side together with the fifth inkjet head 11K for black.

In this configuration example, image formation is performed by using plural inkjet heads 11 for a single can body 10. Further, in this configuration example, image formation is performed for each of the plural can bodies 10 provided to the single moving unit 550 by using ink of the same color.

Specifically, for example, in the moving unit 550 positioned on the most upstream side in the figure, in which three can bodies 10 are provided, any one of the three can bodies 10 is subjected to image formation by using ink of two colors of white and cyan.

In the configuration example shown in FIG. 1, the need to stop the moving unit 550 and to restart moving occurs each time an image of one color is formed, and therefore, it is necessary to perform five times of stopping and restarting moving in total. In the configuration example shown in FIG. 9, only three times of stopping and restarting moving are needed, and it is possible to increase printing efficiency.

Figure 10A:
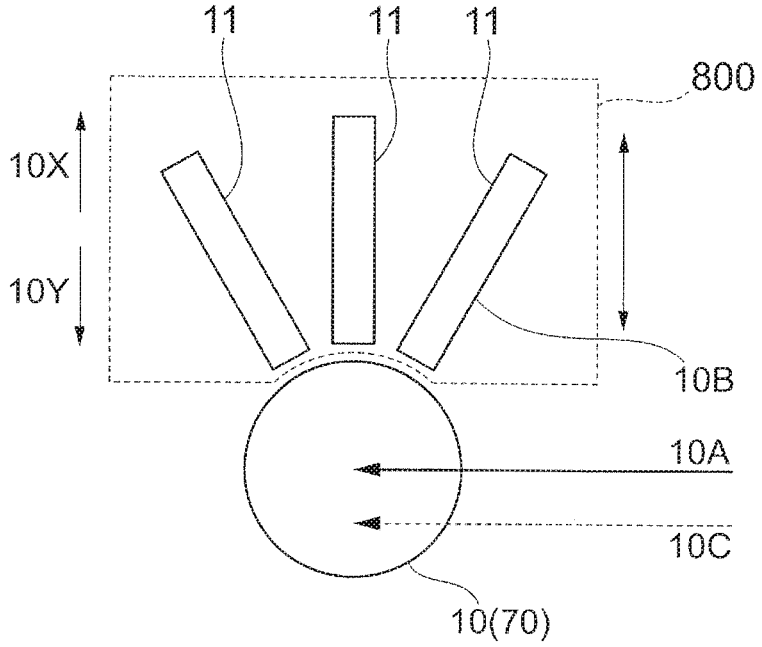
FIGS. 10A and 10B are diagrams showing other arrangement examples of the inkjet heads.
Figure 10B:
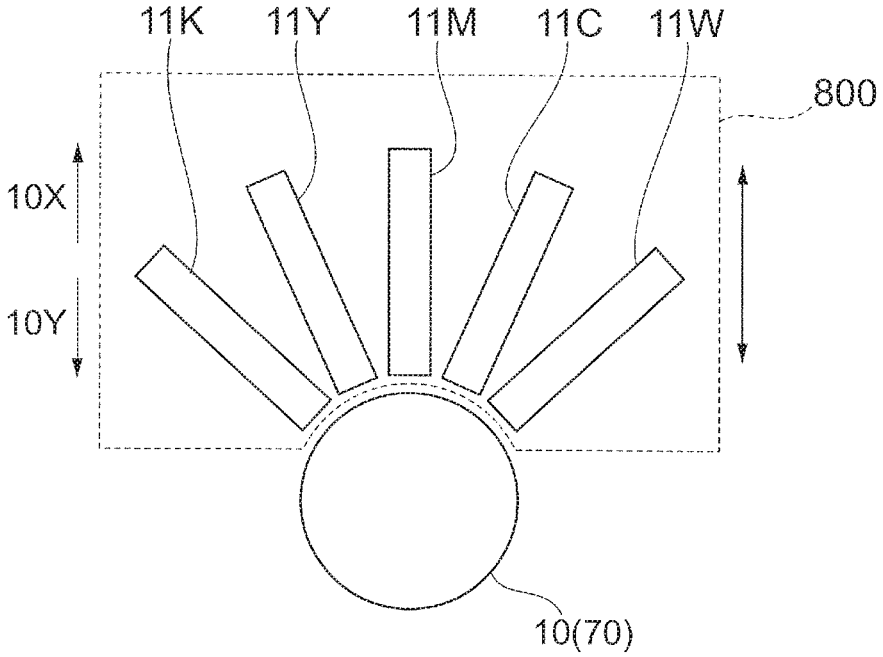

Note that, in FIG. 9, description was given of the case, as an example, in which the two inkjet heads 11 are installed above the single mandrel 70; however, as shown in FIGS. 10A and 10B (diagrams showing other disposing examples of the inkjet heads 11), three or more mandrels 70 may be installed above the single mandrel 70 (can body 10).

Moreover, like this, when the plural inkjet heads 11 are installed above the single mandrel 70, as shown in FIGS. 10A and 10B, a reciprocating mechanism 800 that moves the plural inkjet heads 11 forward and backward with respect to the mandrel 70 (the can body 10) may be provided.

To specifically describe, in the exemplary embodiment, as indicated by the arrow 10A in FIG. 10A, the can body 10 (the mandrel 70) moves along the horizontal direction and linearly, and, in this case, there is a possibility that the inkjet head 11 on the most upstream side (the inkjet head 11 indicated by the reference sign 10B) and the can body 10 interfere with each other.

To avoid the interference, as indicated by the arrow 10C, the can body 10 may be moved to pass through a location away from the inkjet head 11; however, in this case, the can body 10 is moved away from the inkjet head 11, and accordingly, there is a possibility that the quality of image is deteriorated.

In contrast thereto, by providing the reciprocating mechanism 800, it becomes possible to prevent the inkjet head 11 and the can body 10 from interfering with each other, and to dispose the can body 10 near the inkjet head 11.

To describe processing by the reciprocating mechanism 800 in detail, when the can body 10 is conveyed, the inkjet heads 11 are moved in the direction indicated by the arrow 10X in FIGS. 10A and 10B, to thereby retract the inkjet heads 11 on a side away from the moving route of the can body 10.

Then, when the can body 10 is stopped below the inkjet heads 11, as indicated by the arrow 10Y, the inkjet heads 11 are moved toward the can body 10. Thereafter, ejection of ink from the inkjet heads 11 is started to perform image formation onto the can body 10.

When image formation is finished, the inkjet heads 11 are moved in the direction indicated by the arrow 10X, to thereby retract the inkjet heads 11. Then, conveyance of the can body 10 is restarted.

Consequently, it becomes possible to prevent the inkjet head 11 and the can body 10 from interfering with each other, and to dispose the inkjet head 11 near the can body 10.

Note that the reciprocating mechanism can be configured with known techniques, and, for example, it is possible to configure thereof with a motor, a solenoid and the like.

Note that, in FIG. 10, the case in which the inkjet heads 11 are moved (vertically moved) was described; however, the can body 10 may be vertically moved.

Moreover, as shown in FIG. 10B, when five inkjet heads 11 are installed above the single can body 10, printing onto the can body 10 can be finished by only a single rotation of the can body 10.

Figure 11:
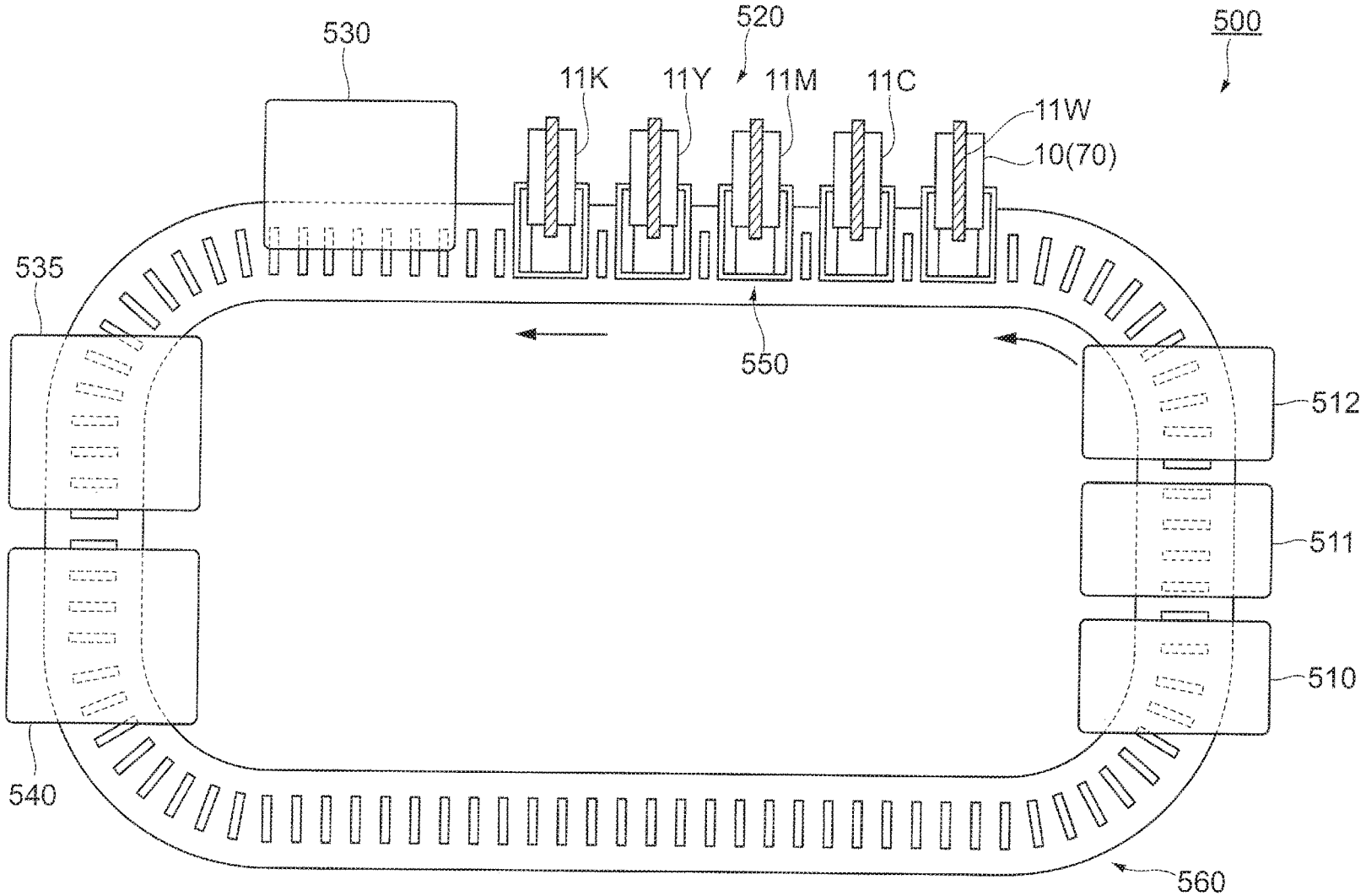
FIG. 11 is a diagram showing another configuration example of the printing device.

FIG. 11 is a diagram showing another configuration example of the printing device 500.

In the configuration example, the moving mechanism 560 is formed into substantially a rectangular shape.

Further, in the configuration example, between the can body loading unit 510 and the printing unit 520, an abnormality detection unit 511 and an abnormal product discharge unit 512 are provided. Further, between the drying unit 530 and the can body discharge unit 540, an outer surface coating unit 535 is provided.

The abnormality detection unit 511 detects abnormality in the can body 10. More specifically, abnormality in the shape of the can body 10, such as a flaw or a dent, or abnormality in mounting the can body 10 is detected. For example, if part of the can body 10 is projected outward than the outer circumferential surface of the can body 10, the projection is detected, and thereby abnormality in the can body 10 is detected.

The abnormality detection unit 511 is provided with, for example, a so-called transmission sensor, in which a light emitting portion and a light receiving portion are provided. If a projecting portion is generated on the can body 10 as described above, light heading from the light emitting portion to the light receiving portion is cut off by the projecting portion. Consequently, abnormality in the can body 10 is detected. Similarly, flaws or dents on the can body 10 or abnormality in mounting the can body 10 may also be detected by use of various kinds of sensors.

The abnormal product discharge unit 512 is configured in the same manner as the can body discharge unit 540; when a can body 10 having abnormality is conveyed, the abnormal product discharge unit 512 supplies compressed air to the inside of the mandrel 70 that supports the can body 10. Consequently, the can body 10 is detached from the mandrel 70. Note that the can body 10 detached from the mandrel 70 (the can body 10 having abnormality) is conveyed to a predetermined location by a not-shown conveyance mechanism.

The outer surface coating unit 535 coats the outer circumferential surface of the can body 10 with paint, to thereby form a protection layer on the outer circumferential surface of the can body 10. The outer surface coating unit 535 is provided with a roller (not shown) to be brought into contact with the outer circumferential surface of the can body 10, and the outer circumferential surface of the can body 10 is coated with paint by use of the roller to form the protection layer.

Figure 12:
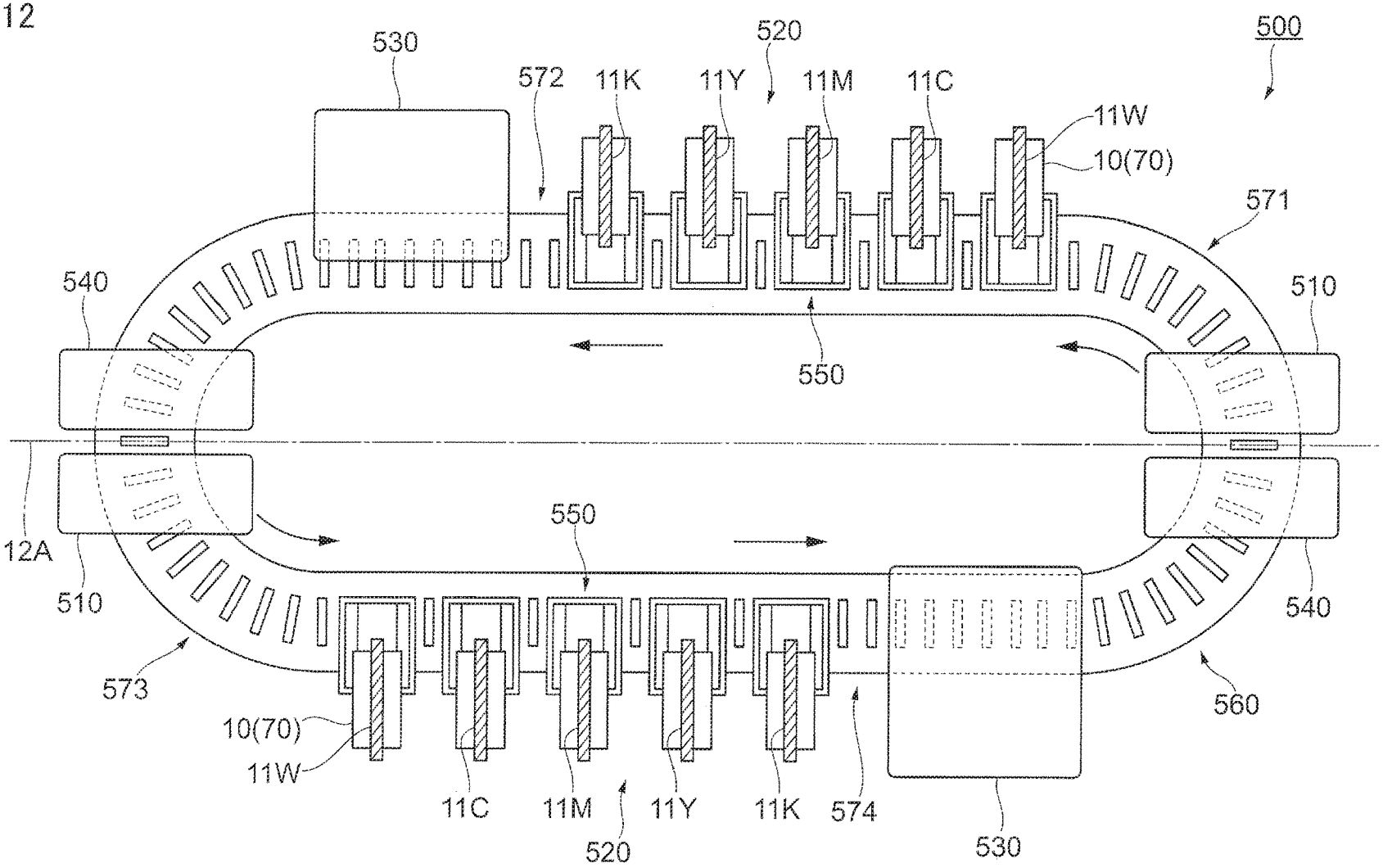
FIG. 12 is a diagram showing another configuration example of the printing device.

FIG. 12 is a diagram showing another configuration example of the printing device 500.

The configuration example is provided with two pairs of basic configurations, each of which is configured with the can body loading unit 510, the printing unit 520, the drying unit 530 and the can body discharge unit 540. Consequently, in the configuration example, it is possible to increase the number of can bodies 10 on which printing can be performed per unit time.

Specifically, the basic configuration (the can body loading unit 510, the printing unit 520, the drying unit 530 and the can body discharge unit 540) of the first pair is positioned above the straight line 12A extending in the horizontal direction in the figure.

Here, similar to the above, in the basic configuration of the first pair, the can body loading unit 510 is positioned on the first curve portion 571, the printing unit 520 and the drying unit 530 are positioned on the first linear portion 572, and the can body discharge unit 540 is positioned on the second curve portion 573.

Moreover, the basic configuration (the can body loading unit 510, the printing unit 520, the drying unit 530 and the can body discharge unit 540) of the second pair is positioned below the straight line 12A in the figure.

Here, in the basic configuration of the second pair, the can body loading unit 510 is positioned on the second curve portion 573, the printing unit 520 and the drying unit 530 are positioned on the second linear portion 574, and the can body discharge unit 540 is positioned on the first curve portion 571.

In the configuration example shown in FIG. 12, as a result of providing two pairs of basic configurations, the number of can bodies 10 on which printing can be performed per unit time is also doubled.

Note that, in the configuration example, description was given of the case in which the two pairs of basic configurations are provided; however, this is merely an example, and there may be provided three or more basic configurations. Moreover, the abnormality detection unit 511, the abnormal product discharge unit 512 and the outer surface coating unit 535 may be installed in each of the basic configurations.

Figure 13:
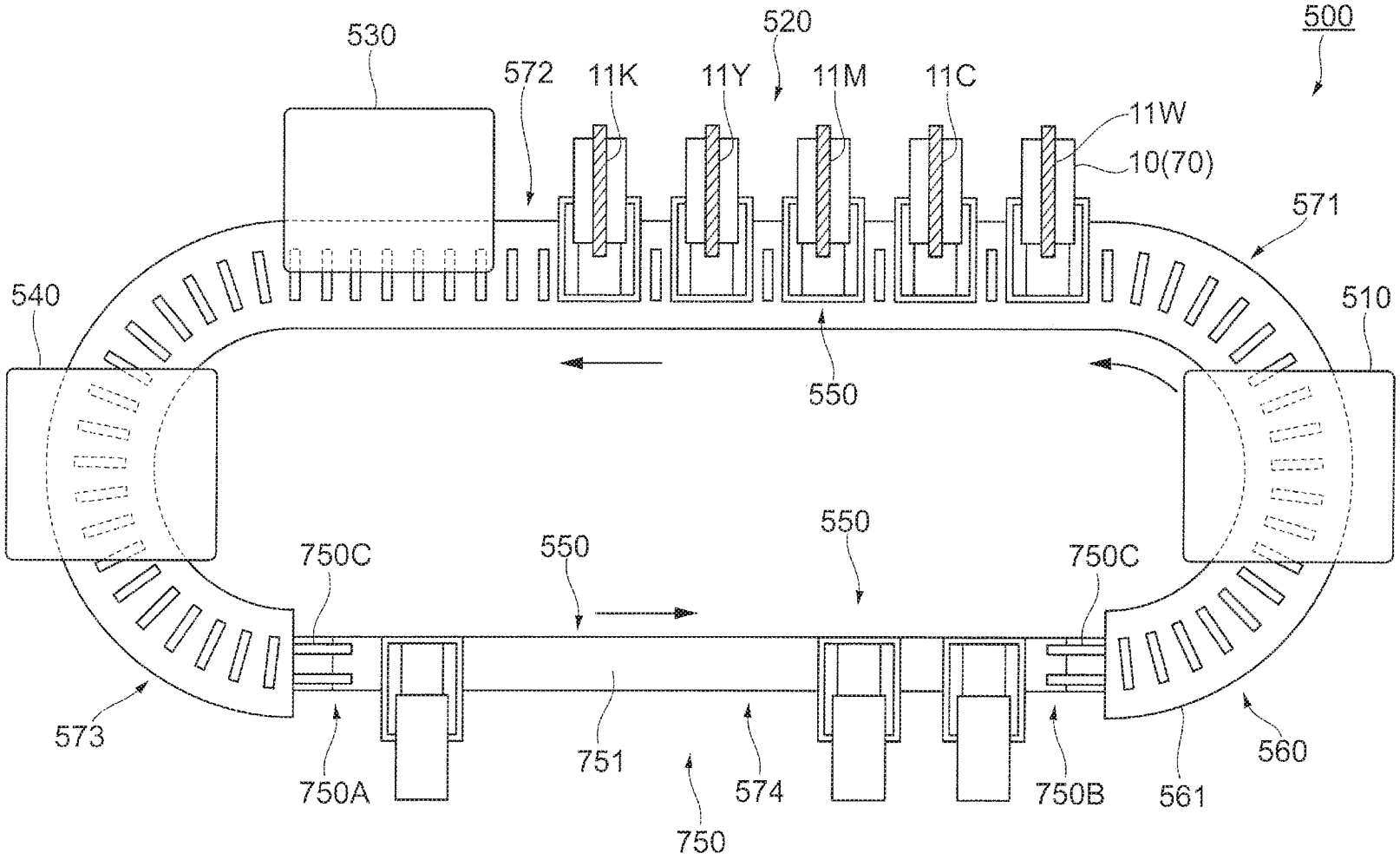
FIG. 13 is a diagram showing another configuration example of the printing device.

FIG. 13 is a diagram showing another configuration example of the printing device 500.

In the configuration examples described above, the guide member 561 was placed on the whole circumference of the orbital route on which the moving unit 550 moves, and, by use of the linear mechanism, the moving unit 550 was moved along the whole circumference.

By the way, the installation range (of the guide member 561) of the moving mechanism 560 is not limited to the whole circumference, and, as shown in FIG. 13, the installation range may be a part of the orbital route. In the configuration example shown in FIG. 13, a part of the moving mechanism 560 is changed to a belt conveyance device 750. In other words, in the configuration example, the moving unit 550 is moved by use of the linear mechanism in the printing unit 520 or the like, but the moving unit 550 is moved without using the linear mechanism in the second linear portion 574.

The belt conveyance device 750 is provided with a circulating belt 751 that circularly moves, tension rolls (not shown) that extend the circulating belt 751, and a drive motor (not shown) that rotates the tension rolls.

Moreover, between an upstream side portion 750A of the belt conveyance device 750 and the moving mechanism 560, and, between a downstream side portion 750B of the belt conveyance device 750 and the moving mechanism 560, moving rails 750C are provided.

In the configuration example, when the moving unit 550 moves to the upstream side of the belt conveyance device 750, the moving rail 750C enters inside the U-shaped guided member 551 (refer to FIG. 2) provided to the moving unit 550. Then, the moving unit 550 is guided by the moving rail 750C, and thereby the moving unit 550 is moved to the belt conveyance device 750. Then, the moving unit 550 is placed on the circulating belt 751.

Thereafter, by the circulating belt 751, the moving unit 550 is moved to the right direction in the figure, and after that, the moving unit 550 is supported again by the guide member 561 of the moving mechanism 560.

Specifically, the moving unit 550 is moved to the right direction in the figure in the state of being placed on the circulating belt 751, and thereafter, first, the moving unit 550 is supported by the moving rail 750C. Next, the moving unit 550 is guided by the moving rail 750C, and thereby the moving unit 550 arrives at the moving mechanism 560. Then, the moving unit 550 is supported again by the guide member 561 provided to the moving mechanism 560.

In the printing unit 520 or the like, it becomes necessary to control the position of the moving unit 550; however, at the location where any functional unit is not particularly installed, such as the second linear portion 574, it is unnecessary to control the position of the moving unit 550. Further, since the moving mechanism 560 moves the moving unit 550 by use of the linear mechanism, if the moving mechanism 560 is provided to the whole circumference, the production costs of the printing device 500 are increased.

Therefore, in the configuration example, at the location positioned on the opposite side of the location where the printing unit 520 is provided (at the location where no functional unit to perform processing on the can body 10 is provided), a part of the moving mechanism 560 is replaced by the belt conveyance device 750 that is less expensive.

Note that, in FIG. 13, description was given of the case in which the belt conveyance device 750 was installed only to the second linear portion 574; however, the belt conveyance device 750 may be provided to the first curve portion 571 or the second curve portion 573. Further, for example, it may be possible that the moving unit 550 is moved by use of the linear mechanism in the first linear portion 572 and the second linear portion 574, whereas, the moving unit 550 is moved by use of the belt conveyance device 750 in the first curve portion 571 and the second curve portion 573.

Figure 14:
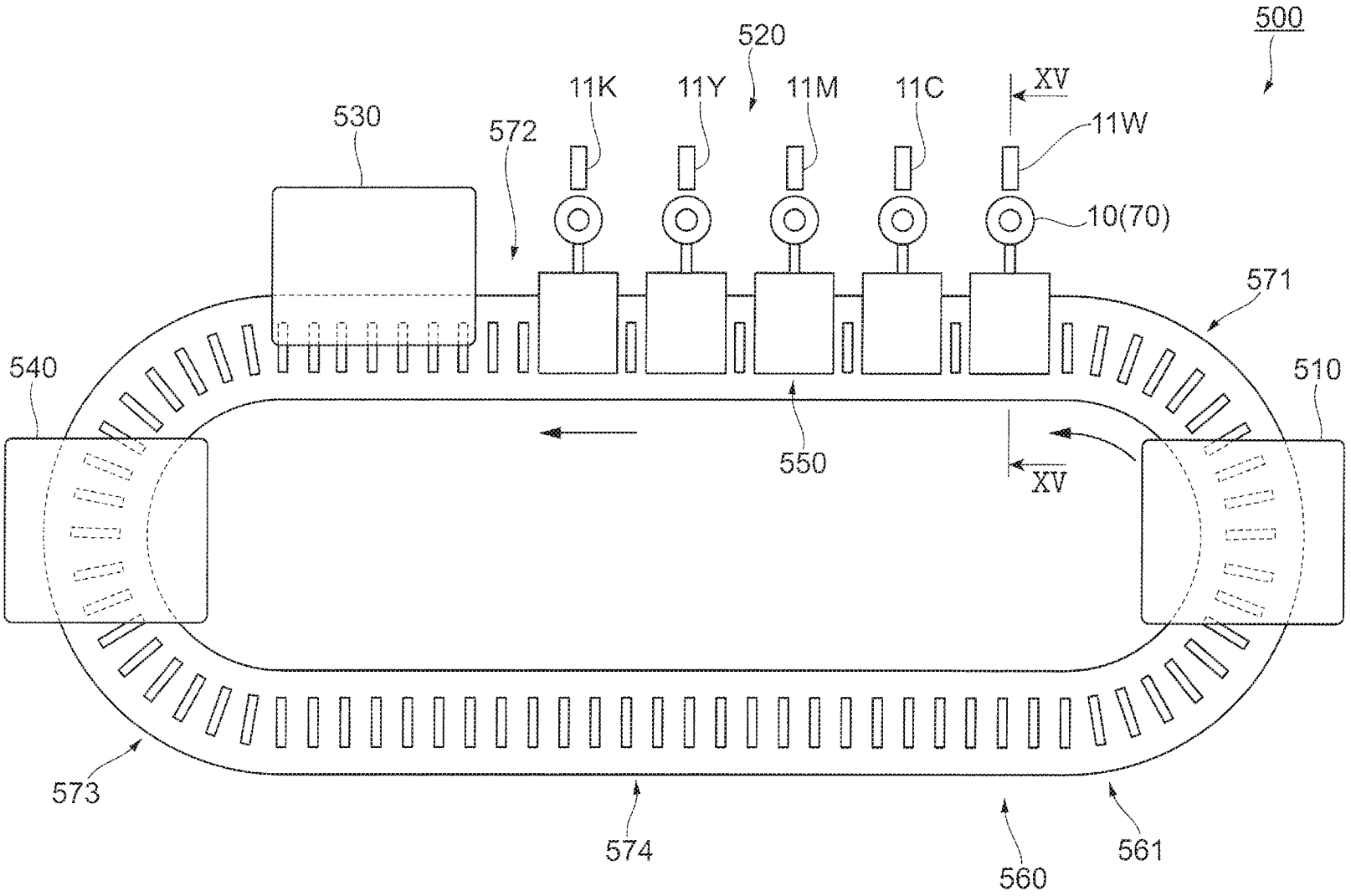
FIG. 14 is a diagram showing another configuration example of the printing device.
Figure 15:
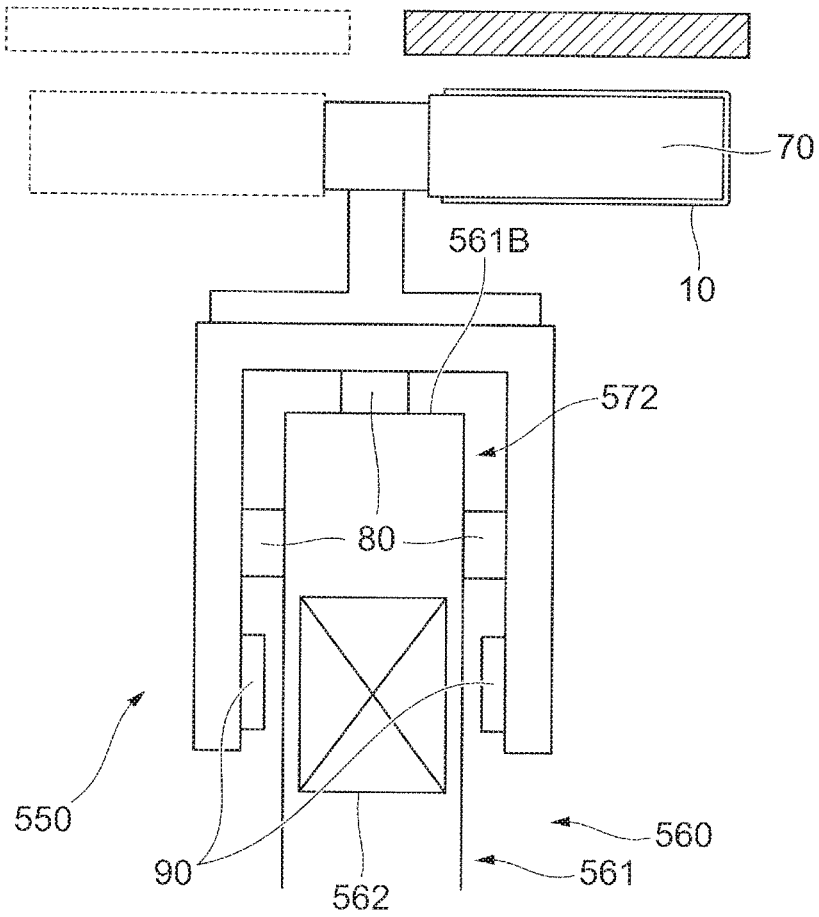
FIG. 15 is a cross-sectional view along the XV-XV line in FIG. 14.

FIG. 14 is a diagram showing another configuration example of the printing device 500. FIG. 15 is a cross-sectional view along the XV-XV line in FIG. 14. Note that, in FIG. 14, a state in which the printing device 500 is viewed from the lateral side of the printing device 500 is shown. Moreover, in FIG. 14, illustration of the mandrel driving mechanism 20 shown in FIG. 4 is omitted.

As shown in FIG. 14, in the configuration example, the printing device 500 is disposed in a vertical position. Specifically, in the printing device 500, the first linear portion 572 is positioned on the upper side, and the second linear portion 574 is positioned below the first linear portion 572.

In FIG. 1 or the like, the printing device 500 in the horizontal position was shown; however, as shown in FIG. 14, the printing device 500 may be placed in the vertical position, not limited to the horizontal position.

In the case where the printing device 500 is in the vertical position, as shown in FIG. 15, when the moving unit 550 is positioned on the first linear portion 572, the moving unit 550 comes to be placed on the outer circumferential surface 561B of the guide member 561 provided to the moving mechanism 560.

Moreover, the mandrel 70 on the moving unit 550 is disposed sideways similar to FIG. 1 and as shown in FIG. 14. Specifically, the mandrel 70 is disposed along the direction perpendicular to (crossing) the moving direction of the moving unit 550.

As in the configuration example, in the case where the printing device 500 is disposed in the vertical position, an occupation area of the printing device 500 is reduced, as compared to the case in which the printing device 500 is disposed in the horizontal position.

On the other hand, in the case of the vertical position, it becomes difficult to use the second linear portion 574 (refer to FIG. 14). In the case of the horizontal position, as shown in FIG. 12, the printing unit 520 and the like can also be installed on the second linear portion 574; however, in the case of the vertical position, it becomes difficult to install the printing unit 520 and the like on the second linear portion 574.

Note that, even in the printing device 500 in the vertical position, various kinds of configurations described above can be applied to the printing device 500 in the vertical position.

For example, the configuration in which the plural mandrels 70 are installed on the moving unit 550 (refer to FIG. 3A), the configuration in which the mandrels 70 are driven by the external driving source (refer to FIG. 4B) or the configuration provided with the abnormality detection unit 511, the abnormal product discharge unit 512 and the outer surface coating unit 535 (refer to FIG. 11) can also be applied to the printing device 500 in the vertical position.

Moreover, the configuration provided with plural sets of the printing unit 520 and others (refer to FIG. 12), the configuration in which the plural inkjet heads 11 are installed above the single mandrel 70 (refer to FIG. 9), the configuration in which the inkjet heads 11 are moved forward and backward (refer to FIG. 10) or the like can also be applied to the printing device 500 in the vertical position.

Figure 16:
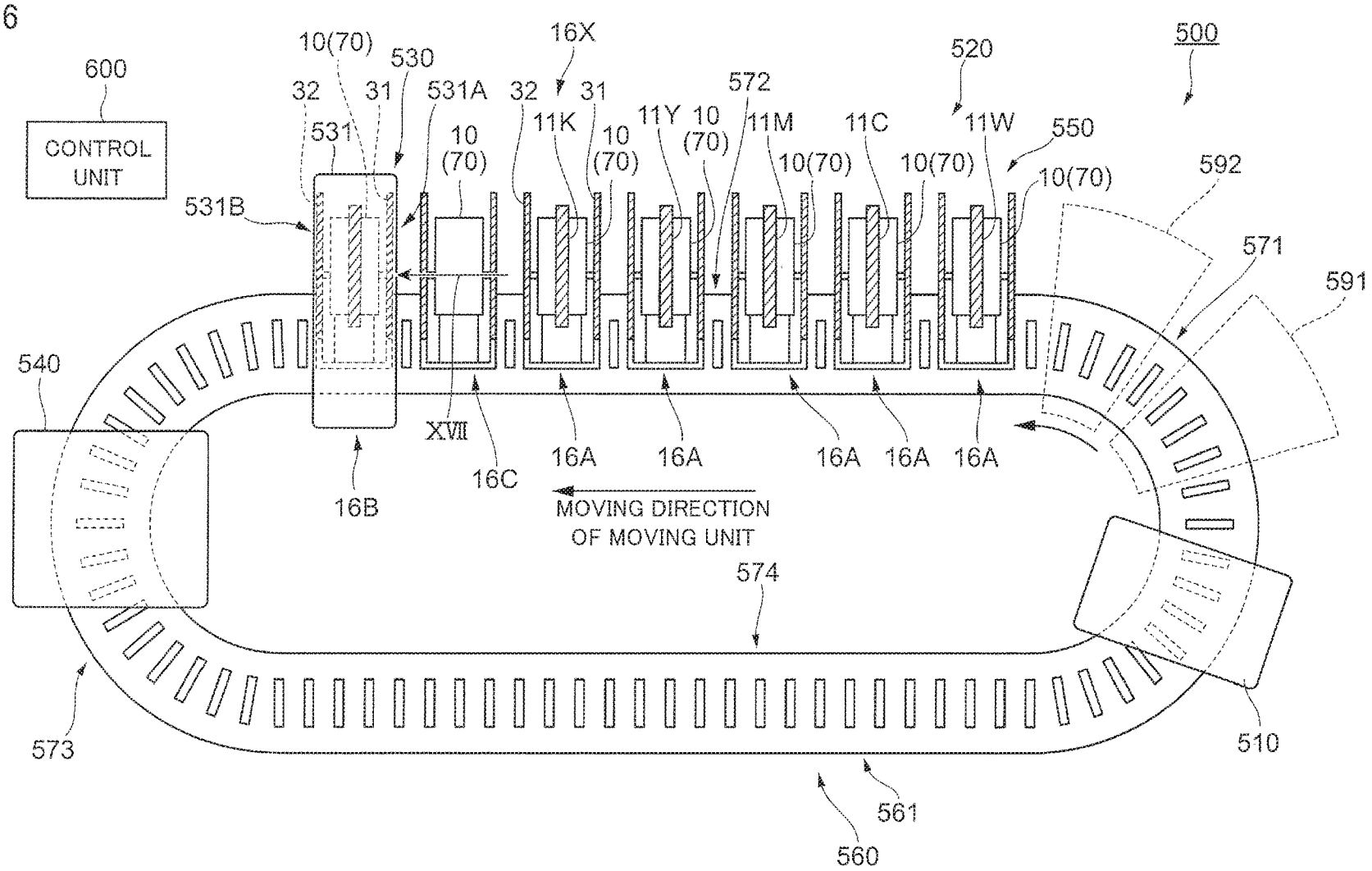
FIG. 16 is a diagram showing another configuration example of the printing device.

FIG. 16 is a diagram showing another configuration example of the printing device 500.

In the configuration example shown in FIG. 16, the configuration includes one or more other can body stop locations provided between image formation stop locations and a light irradiation stop location. Moreover, in the configuration examples described above, five moving units 550 were mainly illustrated; however, in FIG. 16, more than five moving units 550 are illustrated.

In the configuration example shown in FIG. 16, also, the can bodies 10 are sequentially conveyed, and every time each of the can bodies 10 reaches each of predetermined plural can body stop locations, the can body 10 is temporarily stopped.

Specifically, every time the can body 10 reaches each of the inkjet heads 11 and every time the can body 10 reaches the stop location other than the inkjet heads 11, movement of the can body 10 is stopped.

More specifically, every time the can body 10 reaches each of the image formation stop locations indicated by the reference signs 16A (hereinafter, referred to as "image formation stop location 16A"), the can body 10 is stopped, and in each of the first curve portion 571, the second curve portion 573 and the second linear portion 574, the can body 10 is stopped at a predetermined stop location.

Further, in the exemplary embodiment, the can body 10 is stopped at a light irradiation stop location 16B on the downstream side of the image formation stop locations 16A in the conveyance direction of the can body 10. To put it another way, at the drying unit 530 that performs irradiation with ultraviolet light, the can body 10 is stopped.

Here, though description was omitted in the above, the drying unit 530 is provided with a light source (not shown) that emits ultraviolet light and a light source container box 531 that contains the light source. The light source container box 531 is provided with an inlet portion 531A and an outlet portion 531B, and the can body 10 (the moving unit 550) passes through the inlet portion 531A to enter inside the light source container box 531. Moreover, the can body 10 passes through the outlet portion 531B to go out of the light source container box 531.

Here, in the configuration example, there is provided a can body stop location 16C where neither image formation nor light irradiation is performed between the image formation stop location 16A (the image formation stop location 16A positioned at the most downstream side) and the light irradiation stop location 16B, and thereby ultraviolet light is less likely to reach the inkjet head 11.

In the exemplary embodiment, ultraviolet light is emitted in the drying unit 530, and when the ultraviolet light reaches the inkjet head 11 positioned on the upstream side, there occurs a possibility that the ink is cured to cause ink clogging in the inkjet head 11, and thereby quality of an image to be formed is deteriorated.

Therefore, in the exemplary embodiment, by providing the single can body stop location 16C between the image formation stop locations 16A and the light irradiation stop location 16B to increase a separation distance between the drying unit 530 and the inkjet head 11, to thereby reduce ultraviolet light that reaches the inkjet head 11.

Note that, in the exemplary embodiment, there was provided the single can body stop location 16C between the image formation stop locations 16A and the light irradiation stop location 16B; however, two or more can body stop locations 16C may be provided.

Moreover, in the configuration example shown in FIG. 16, as indicated by the reference sign 16X, an upstream-side restricting wall 31 and a downstream-side restricting wall 32 are provided beside each can body 10 (each mandrel 70).

The upstream-side restricting wall 31 is positioned on the upstream side of the can body 10 in the moving direction of the moving unit 550, and the downstream-side restricting wall 32 is positioned on the downstream side of the can body 10 in the moving direction of the moving unit 550.

Moreover, the upstream-side restricting wall 31 and the downstream-side restricting wall 32 are disposed along the axial direction of the can body 10 and also along the vertical direction.

Moreover, the plural (plural sets of) upstream-side restricting walls 31 and downstream-side restricting walls 32 are provided to correspond to the respective plural moving units 550 (can bodies 10), and move in association with the respective moving units 550.

The upstream side restricting wall 31 is positioned on the upstream side (the side on which an inkjet head 11 is provided) of a can body 10 when the can body 10 is stopped at the light irradiation stop location 16B (the drying unit 530). The upstream-side restricting wall 31 is thereby positioned between the can body 10 and the inkjet head 11, and ultraviolet light is restricted from heading toward the inkjet head 11.

Moreover, when the can body 10 is stopped at the light irradiation stop location 16B (the drying unit 530), the downstream-side restricting wall 32 is positioned on the downstream side of the can body 10. Consequently, ultraviolet light is restricted from heading toward the downstream side of the can body 10.

Figure 17:
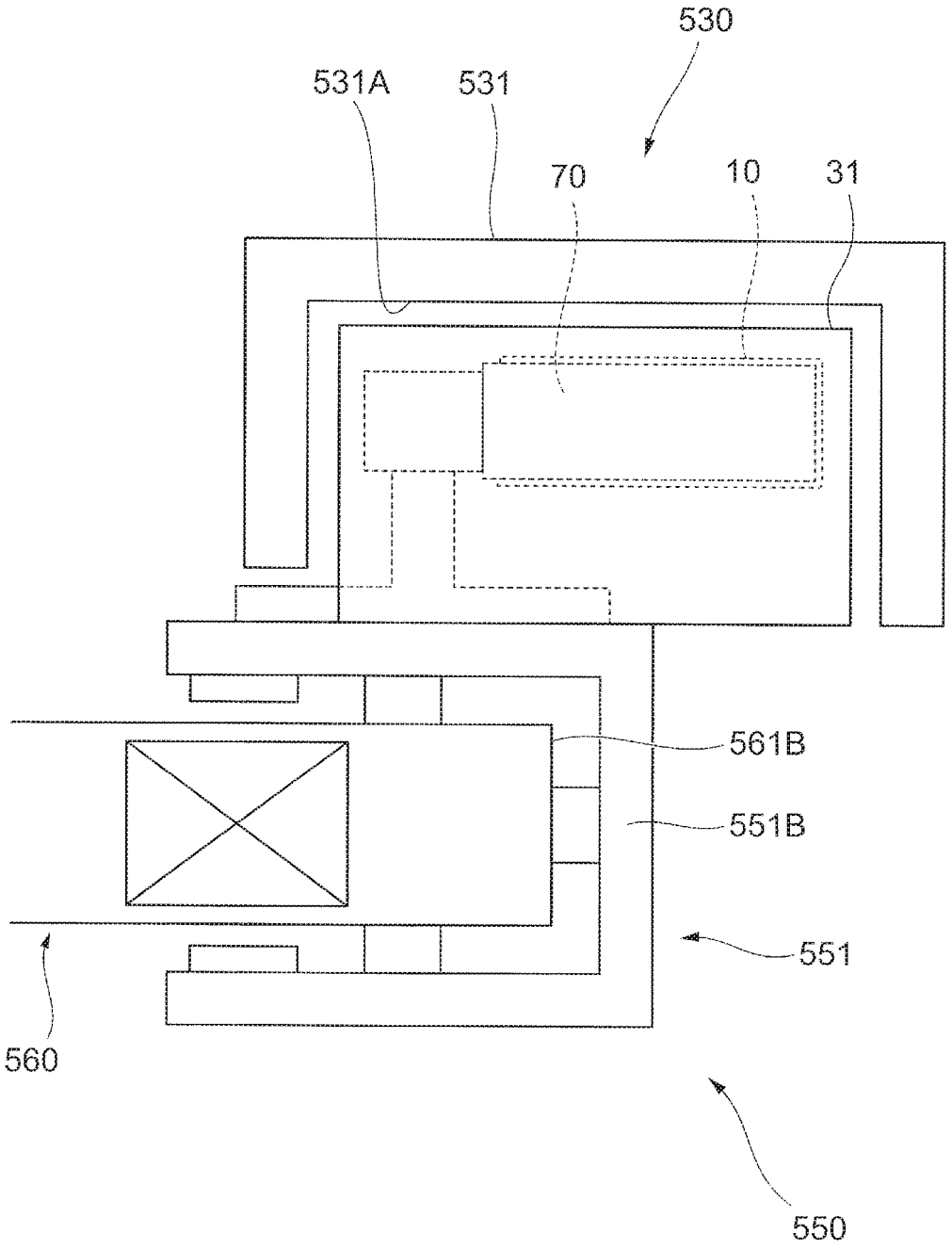
FIG. 17 is a diagram in which a drying unit is viewed from a direction of the arrow XVII in FIG. 16.

FIG. 17 is a diagram in which the drying unit 530 is viewed from a direction of the arrow XVII in FIG. 16.

As shown in FIG. 17, the drying unit 530 is provided with the light source container box 531. Then, the light source container box 531 is provided with, as described above, the inlet portion 531A.

Here, in this configuration example, when the can body 10 is stopped at the inside of the light source container box 531, the upstream-side restricting wall 31 provided corresponding to the can body 10 closes the inlet portion 531A of the light source container box 531. Consequently, the ultraviolet light is prevented from heading toward the inkjet head 11 through the inlet portion 531A.

Moreover, as shown in FIG. 16, the downstream-side restricting wall 32 also closes the outlet portion 531B of the light source container box 531 while the can body 10 is stopped at the inside of the light source container box 531. Consequently, leakage of the ultraviolet light from the outlet portion 531B of the light source container box 531 can be suppressed.

Moreover, in the configuration example shown in FIG. 16, between the can body loading unit 510 (refer to FIG. 16) and the printing unit 520, a can body inspection unit 591 and a can body discharge unit 592 are provided.

The can body inspection unit 591 performs inspection of a can body 10 before image formation onto the can body 10 by the printing unit 520 is performed.

In the can body discharge unit 592, a can body 10, which is determined not to satisfy a predetermined condition by the can body inspection unit 591, is discharged. Specifically, similar to the processing in the can body discharge unit 540, the compressed air is supplied to the inside of the mandrel 70, and thereby the can body 10 is discharged.

Figure 18:
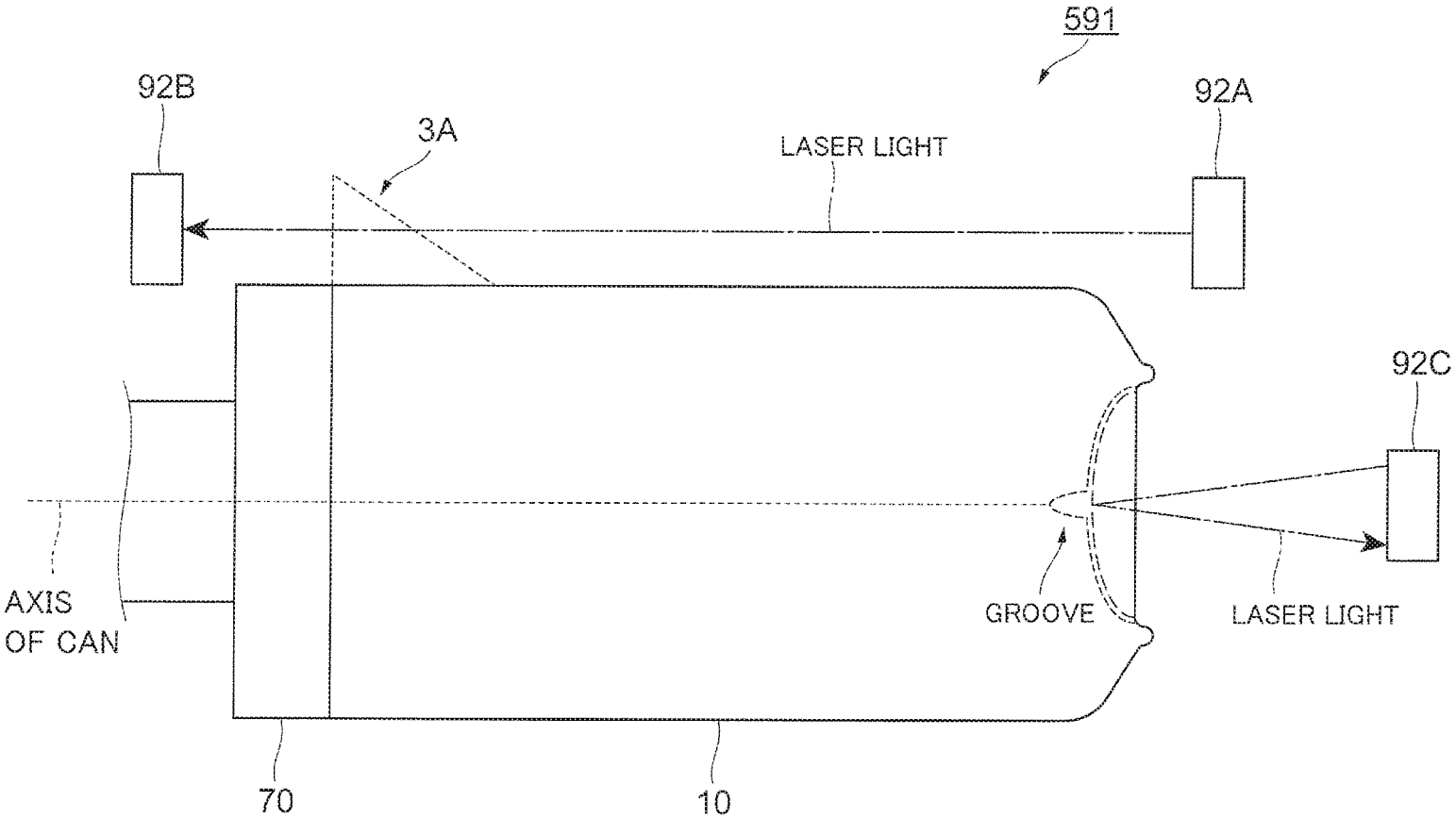
FIG. 18 is a diagram showing a configuration of a can body inspection unit.

FIG. 18 is a diagram showing a configuration of the can body inspection unit 591.

The can body inspection unit 591 shown in FIG. 18 inspects whether or not the can body 10 is deformed.

Specifically, the can body inspection unit 591 is provided with a light source 92A on one end portion side of the can body 10, the light source 92A emitting laser light that proceeds in the axial direction of the can body 10 along the outer circumferential surface of the can body 10. Further, on the other end portion side of the can body 10, there is provided a light receiving portion 92B that receives laser light from the light source 92A.

When a part of the can body 10 is deformed as indicated by the reference sign 3A, the laser light is cut off and the light receiving portion 92B cannot receive the laser light. Consequently, deformation of the can body 10 is detected.

Moreover, the can body inspection unit 591 is provided with a reflective laser detection device 92C including both of a light source that emits laser light and a light receiving portion that receives the laser light. The reflective laser detection device 92C emits laser light from the light source toward a bottom of a can. The emitted laser light is reflected on the bottom of the can, and the reflected laser light is received by the light receiving portion.

In the reflective laser detection device 92C, the distance to the bottom of the can is detected based on the time from light emission to light reception, and thereby, whether or not the can body 10 is completely attached to the mandrel 70 is detected. Note that, by providing a groove onto the mandrel 70, it is possible to detect presence or absence of the can body 10.

Then, in the configuration example, in the can body inspection unit 591, when it is determined that the can body 10 does not satisfy the predetermined condition (when it is determined that the can body 10 is deformed), or when it is determined that the can body 10 is incompletely attached to the mandrel 70, the can body 10 is discharged in the can body discharge unit 592.

Figure 19:
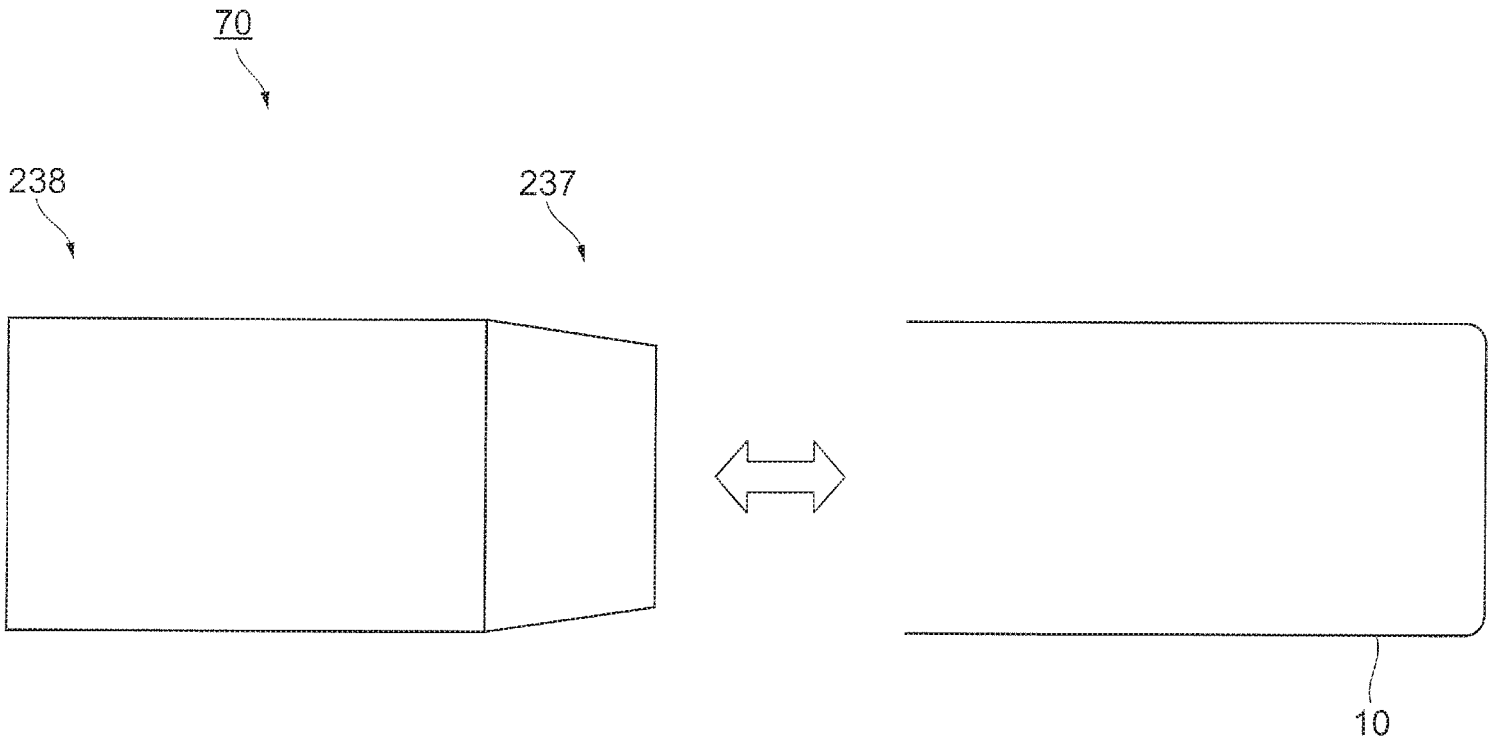
FIG. 19 is a diagram showing another configuration example of a mandrel.

FIG. 19 is a diagram showing another configuration example of the mandrel 70.

In the mandrel 70 shown in FIG. 19, the diameter of one end portion 237 is smaller than the diameter of the other end portion 238.

More specifically, in this configuration example, when the mandrel 70 is inserted into the can body 10 with the one end portion 237 in the lead, and the diameter of the one end portion 237 side is smaller than the diameter of the other end portion 238 side. To describe further, in the exemplary embodiment, the outer circumferential surface and the one end portion 237 of the mandrel 70 are tapered in such a way that the outer diameter of the mandrel 70 is reduced with a move from the other end portion 238 side toward the one end portion 237 side.

Here, when the diameter of the one end portion 237 side is made smaller than the diameter of the other end portion 238 side as in the exemplary embodiment, wear of the mandrel 70 is suppressed.

More specifically, when the mandrel 70 is inserted into the can body 10, a leading end of the mandrel 70 is less likely to be brought into contact with the can body 10, and therefore, wear of the mandrel 70 is suppressed.

Note that, in this configuration example, as a result of the diameter of the one end portion 237 side being made smaller, a gap is formed between the outer circumferential surface of the one end portion 237 and the inner circumferential surface of the can body 10. In the exemplary embodiment, even though such a gap exists, since printing is performed by the inkjet method (since printing is performed by adhering ink changed into minute ink droplets, and no external force is generated in the can body 10 during printing), image formation onto the can body 10 can be performed without deforming the can body 10 by printing.

Here, in a plate processing method, not in the inkjet method, that transfers an image by pressing a plate against the outer circumferential surface of the can body 10, the can body 10 is dented inward at the portion where the gap is formed, and thereby the can body 10 is deformed.

Other than this, in the above, there was no particular description of the number of rotations of the can body 10; however, the number of rotations of the can body 10 may be controlled.

Specifically, for example, it may be possible to control the number of rotations of the can body 10 so that the number of rotations of the can body 10 during a period from starting to move the can body 10 from one of the two inkjet heads 11 adjacent to each other in the moving direction of the can body 10 to reaching the other thereof becomes an integer.

Specific description will be given with reference to FIG. 20 (a schematic view in a case where two inkjet heads 11 adjacent to each other are viewed).

Figure 20:
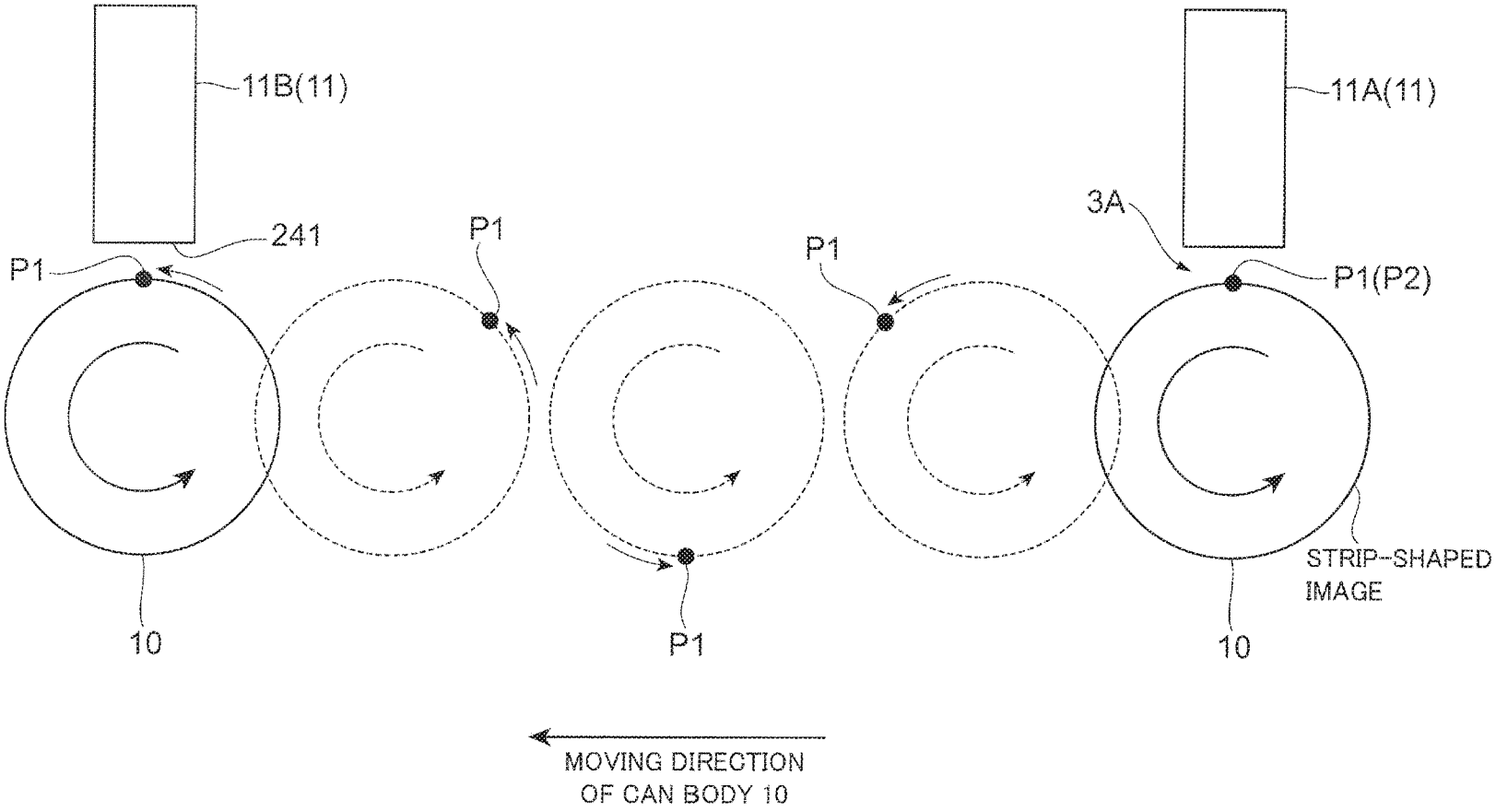
FIG. 20 is a schematic view in a case where two inkjet heads adjacent to each other are viewed.

In the processing shown in FIG. 20, the can body 10 is always rotating, and the can body 10 moves from one of the inkjet heads 11 positioned on the upstream side (the inkjet head on the right side in the figure, which is hereinafter referred to as "upstream-side inkjet head 11A") to the other one of the inkjet heads 11 positioned on the downstream side (the inkjet head 11 on the left side in the figure, which is hereinafter referred to as "downstream-side inkjet head 11B") while rotating.

Then, in the processing, the number of rotations of the can body 10 during the period from starting to move the can body 10 from the upstream-side inkjet head 11A to reaching the downstream-side inkjet head 11B is an integer.

Consequently, in the exemplary embodiment, when the can body 10 reaches the downstream-side inkjet head 11B, an adhesion starting position P1, where the ink ejected from the upstream-side inkjet head 11A is adhered first, is positioned at a position facing the downstream-side inkjet head 11B.

Here, in the upstream-side inkjet head 11A, a strip-shaped image extending from the adhesion starting position P1 (the position indicated by the reference sign 3A) where the ink is first adhered to an adhesion finishing position P2 (the position indicated in the same manner by the reference sign 3A) where the ink is finally adhered is formed on the outer circumferential surface of the can body 10.

Then, in the exemplary embodiment, the can body 10 moves while rotating, and when the can body 10 reaches below the downstream-side inkjet head 11B, the adhesion starting position P1 is located at the position facing the lower surface 241 of the downstream-side inkjet head 11B.

Then, in the exemplary embodiment, ink is ejected at the same time when the can body 10 reaches below the downstream-side inkjet head 11B, to thereby perform image formation.

More specifically, in the exemplary embodiment, movement of the can body 10 is started at the same time when image formation is finished at the upstream-side inkjet head 11A (at the same time when the adhesion starting position P1 faces the upstream-side inkjet head 11A again after the single rotation of the can body 10).

Then, at the same time when the can body 10 reaches below the downstream-side inkjet head 11B (at the same time when the adhesion starting position P1 faces the downstream-side inkjet head 11B), ejection of ink from the downstream-side inkjet head 11B is started, to thereby start image formation.

Here, in this processing, when image formation at the downstream-side inkjet head 11B is started, the adhesion starting position P1 is positioned directly below the downstream-side inkjet head 11B.

Consequently, in the exemplary embodiment, an image formation starting position when image formation at the upstream-side inkjet head 11A is started and an image formation starting position when image formation at the downstream-side inkjet head 11B is started coincide with each other.

Here, if the adhesion starting position P1 does not face the downstream-side inkjet head 11B when the can body 10 reaches the downstream-side inkjet head 11B, control for causing the adhesion starting position P1 to face the downstream-side inkjet head 11B is required.

Specifically, it becomes necessary to, for example, detect the state of the can body 10 by a rotary encoder or the like, and rotate the can body 10 based on the detection result. In contrast to this, in the exemplary embodiment, such control is unnecessary and the image formation starting positions can be aligned easier.

Note that the number of rotations of the can body 10 during the period from starting to move the can body 10 from the upstream-side inkjet head 11A to reaching the downstream-side inkjet head 11B may be any value as long as being an integer, which may be 1, or may be 2 or more.

Moreover, as another processing, when the can body 10 moves from one inkjet head 11 of the two inkjet heads 11 adjacent each other to the other inkjet head 11, the can body 10 may be rotated at the number of rotations larger than a predetermined number of rotations (the number of rotations in image formation).

More specifically, when an image is formed onto the can body 10 in each inkjet head 11, the can body 10 is rotated at the predetermined number of rotations, whereas, when the can body 10 is moved (in the course of moving the can body 10), the can body 10 may be rotated at the number of rotations larger than the predetermined number of rotations.

Here, when the number of rotations is increased like this, the ink on the outer circumferential surface of the can body 10 is more likely to be cured. More specifically, when thermosetting ink, not the ultraviolet cure ink as in the exemplary embodiment, is used for example, the ink is likely to be dried as the number of rotations is increased, and thereby, the ink is cured more quickly as compared to a case in which the number of rotations is not increased.

To additionally describe, in the above, the case in which the ultraviolet cure ink is used was described; however, thermosetting ink can also be used, and in this case, when the number of rotations of the can body 10 is increased, the ink is cured more quickly as compared to a case in which the number of rotations is not increased.

Moreover, as another processing, when the can body 10 moves from one inkjet head 11 of the two inkjet heads 11 adjacent each other to the other inkjet head 11, the can body 10 may be rotated at the number of rotations smaller than the predetermined number of rotations.

More specifically, when an image is formed onto the can body 10 in each inkjet head 11, the can body 10 is rotated at the predetermined number of rotations, whereas, when the can body 10 is moved (in the course of moving the can body 10), the can body 10 may be rotated at the number of rotations smaller than the predetermined number of rotations.

When the number of rotations of the can body 10 is reduced in this manner, the total number of rotations of mechanical sections for rotating the can body 10 is reduced, and thereby wear in the mechanical sections can be suppressed as compared to a case in which the number of rotations of the respective mechanical sections is constant or is increased as described above.

Moreover, in each inkjet head 11, image formation onto the can body 10 may be started after the can body 10 is rotated a predetermined number of times below the inkjet head 11, not to start image formation at the same time when the can body 10 reaches the inkjet head 11.

Immediately after the can body 10 is moved to the location below each inkjet head 11, the can body 10 does not absolutely stop and vibrates in some cases. Particularly, when the moving speed of the can body 10 is high, vibration of the can body 10 is more likely to become large. The vibration of the can body 10 is apt to cause degradation in quality of the image to be formed on the can body 10.

In contrast thereto, by starting the image formation by the inkjet head 11 after rotating the can body 10 below the inkjet head 11 (by starting the image formation by the inkjet head 11 after a certain time has passed), the vibration of the can body 10 is reduced or no vibration occurs, and thereby degradation of the image to be formed on the can body 10 is suppressed.

Other than this, it may be possible to stop the rotation of the can body 10 or reduce the rotation speed of the can body 10 while the can body 10 reaches below the inkjet head 11 and is rotated for a certain period of time. However, in this case, when image formation by the inkjet head 11 is started, it is necessary to accelerate the can body 10, which has been stopped or decelerated, to the rotation speed required to perform image formation, and vibration sometimes occurs in the can body 10 on this occasion.

Moreover, as another control, it may be possible that the image formation starting position when the inkjet head 11 starts image formation (the position of the can body 10 in the circumferential direction) is made to differ in each inkjet head 11, and thereby the image formation starting positions of respective colors are shifted in the circumferential direction of the can body 10.

When the image formation starting positions are aligned, there is a possibility that the portions where the image quality is likely to be deteriorated are concentrated to one location, to result in degradation in image quality. More specifically, at the image formation starting positions, a starting point and an end of the image to be formed overlap or a gap is formed between the starting point and the end, and accordingly, the image quality is likely to be deteriorated. In such a case, if the image formation starting positions are aligned, the image quality is more likely to be deteriorated as compared to the case in which the image formation starting positions are not aligned.

By differentiating the image formation starting position by each inkjet head 11 and shifting the image formation starting positions of the respective colors in the circumferential direction of the can body 10, degradation in image quality can be suppressed.

Note that, as a method of shifting the image formation starting positions by the respective inkjet heads 11, though not particularly limited, for example, by differentiating the ink ejection timing by the respective inkjet heads 11, the image formation starting positions can be shifted.

REFERENCE SIGNS LIST

10 Can body
11 Inkjet head
21 Belt member

22 Drive roll
23 Belt motor
70 Mandrel
71 Mandrel-side gear
89 Reciprocating mechanism
90 Unit-side magnet
500 Printing device
520 Printing unit
550 Moving unit
560 Moving mechanism
562 Electromagnet
600 Control unit

The invention claimed is:

1. A printing device comprising:

a moving body that comprises a driving mechanism for rotating a can body and moves while supporting the can body;

a printing unit that performs printing on the can body supported by the moving body;

a driving source provided to a location different from the moving body to generate a driving force used by the driving mechanism of the moving body;

a first rotating body provided to a location different from the moving body to be rotated by the driving source; and a second rotating body provided to the moving body to receive the driving force used by the driving mechanism of the moving body;

wherein an outer surface of the first rotating body provided to the moving body contacts an outer surface of the second rotating body provided to the location different from the moving body to transmit the driving force of the driving source.

2. The printing device according to claim 1, wherein, in the printing unit, the moving body moves linearly.

3. The printing device according to claim 1, wherein the can body is supported to cause an axial direction of the can body supported by the moving body to intersect a moving direction of the moving body.

4. The printing device according to claim 1, wherein the moving body moves along an annular-shaped route, and the can body supported by the moving body is disposed closer to an outer side than an inner side in a radial direction of the annular-shaped route.

5. The printing device according to claim 1, wherein the moving body is configured to be capable of supporting a plurality of can bodies.

6. A printing device comprising:

a moving body that moves while supporting a can body;

a printing unit that comprises a plurality of image formation units and performs printing on the can body supported by the moving body; and a mover unit that moves the moving body to pass through each of the plurality of image formation units and moves the moving body by using a linear mechanism, wherein, when the moving body is moved by passing through each of the plurality of image formation units, the mover unit moves the moving body by using the linear mechanism, and at a location other than a location provided with the plurality of image formation units, the mover unit moves the moving body without using the linear mechanism.

7. A printing device comprising:

a moving body that comprises a driving mechanism for rotating a can body and moves while supporting the can body;

a printing unit that performs printing on the can body supported by the moving body;

a driving source provided to a location different from the moving body to generate a driving force used by the driving mechanism of the moving body, the driving source being arranged so as not to move with the moving body; and a transmission mechanism that transmits the driving force generated in the driving source to the driving mechanism of the moving body, wherein a plurality of the moving bodies is provided, and the transmission mechanism is brought into contact with the driving mechanism provided to each of the plurality of moving bodies to transmit the driving force to the plurality of driving mechanisms.

8. The printing device according to claim 7, wherein the transmission mechanism transmits the driving force to the plurality of driving mechanisms by using a belt member that circularly moves.

9. The printing device according to claim 7, wherein the transmission mechanism is brought into contact with the driving mechanism of the moving body to transmit the driving force to the driving mechanism, and wherein the printing device further comprises, across the driving mechanism of the moving body, a support member that supports the driving mechanism from an opposite side of a side where the transmission mechanism is placed.

10. The printing device according to claim 7, further comprising:

a reciprocating unit that reciprocates the transmission mechanism with respect to the driving mechanism of the moving body.

11. The printing device according to claim 7, wherein the moving body is provided with a permanent magnet, a moving route of the moving body is provided with electromagnets, and wherein the printing device further comprises a mover unit that controls energization of the electromagnets to move the moving body.

12. A printing device comprising:

a moving body that comprises a driving mechanism for rotating a can body and moves while supporting the can body;

a printing unit that performs printing on the can body supported by the moving body;

a driving source provided to a location different from the moving body to generate a driving force used by the driving mechanism of the moving body; and a transmission mechanism that transmits the driving force generated in the driving source to the driving mechanism of the moving body, wherein a plurality of the moving bodies is provided, and the transmission mechanism is brought into contact with the driving mechanism provided to each of the plurality of moving bodies to transmit the driving force to the plurality of driving mechanisms.

13. A printing device comprising:

a moving body that comprises a driving mechanism for rotating a can body and moves while supporting the can body;

a printing unit that performs printing on the can body supported by the moving body;

a driving source provided to a location different from the moving body to generate a driving force used by the driving mechanism of the moving body; and a transmission mechanism that transmits the driving force generated in the driving source to the driving mechanism of the moving body, wherein the transmission mechanism is brought into contact with the driving mechanism of the moving body to transmit the driving force to the driving mechanism, and wherein the printing device further comprises, across the driving mechanism of the moving body, a support member that supports the driving mechanism from an opposite side of a side where the transmission mechanism is placed.

14. A printing device comprising:

a moving body that comprises a driving mechanism for rotating a can body and moves while supporting the can body;

a printing unit that performs printing on the can body supported by the moving body;

a driving source provided to a location different from the moving body to generate a driving force used by the driving mechanism of the moving body;

a transmission mechanism that transmits the driving force generated in the driving source to the driving mechanism of the moving body, and a reciprocating unit that reciprocates the transmission mechanism with respect to the driving mechanism of the moving body.

* * * * *